US007721506B2

(12) United States Patent
Bennett et al.

(10) Patent No.: US 7,721,506 B2
(45) **Date of Patent: *May 25, 2010**

(54) PANELIZED ROOFING SYSTEM AND METHOD

(75) Inventors: John L. Bennett, Nicholson, GA (US); Joel F. Barker, Townville, SC (US); Rick D. Jordan, Lawrenceville, GA (US); Thomas L. Schuman, Jefferson, GA (US); Nian Ou, Dacula, GA (US); Neil C. Swiacki, Harrisburg, NC (US)

(73) Assignee: Huber Engineered Woods LLC, Commerce, GA (US)

( * ) Notice: Subject to any disclaimer, the term of this patent is extended or adjusted under 35 U.S.C. 154(b) by 1408 days.

This patent is subject to a terminal disclaimer.

(21) Appl. No.: 11/029,293

(22) Filed: Jan. 4, 2005

(65) Prior Publication Data

US 2005/0257469 A1 Nov. 24, 2005

Related U.S. Application Data

(60) Provisional application No. 60/547,029, filed on Feb. 23, 2004, provisional application No. 60/547,031, filed on Feb. 23, 2004.

(51) Int. Cl.
*E04B 2/02* (2006.01)
*E04D 6/00* (2006.01)

(52) U.S. Cl. ..... 52/789.1; 52/408; 52/177; 52/417

(58) Field of Classification Search ..... 52/408, 52/741.1, 459, 177, 417, 789.1; 428/141, 428/156

See application file for complete search history.

(56) References Cited

U.S. PATENT DOCUMENTS 1,257,144 A * 2/1918 Stanwood ..... 52/177

(Continued)

OTHER PUBLICATIONS

U.S. Appl. No. 60/547,029, filed Feb. 23, 2004, Bennett et al., provisional application.

(Continued)

*Primary Examiner*—Brian E Glessner
(74) *Attorney, Agent, or Firm*—Patricia L. Ades; Cheryl J. Tubach

(57) ABSTRACT

The panelized roof sheathing construction system includes a plurality of panels attached to a building frame structure in substantially abutting relationship. Each panel includes a water resistant barrier layer secured atop the outward facing surface of the panel. The water resistant barrier layer includes a skid resistant surface. Joints between panels are sealed by strips of water resistant tape or the like. The panels are made of lignocellulosic material. The water resistant and skid resistant surface may include indicia for aligning strips of tape or for aligning fasteners. A method for manufacturing the water resistant building panels is also disclosed and includes the steps of feeding a roll of paper onto a forming belt, depositing lignocellulosic material and the binding agent onto the forming belt so as to form a lignocellulosic mat, cutting the mat and paper into segments of predetermined lengths, transferring the segments onto a loading screen, subjecting the segments to heat and pressure so as to impart the skid resistant surface on the paper, and cutting the segments into panels of predetermined sizes. A method of drying-in a building using the panels of the invention is also contemplated.

58 Claims, 13 Drawing Sheets

U.S. PATENT DOCUMENTS 3,654,044 A * 4/1972 Hirota ..... 428/151
3,969,181 A * 7/1976 Seabold ..... 156/577
4,053,339 A 10/1977 Story
4,404,252 A 9/1983 Hetzler
4,405,675 A 9/1983 Dessens
4,689,275 A * 8/1987 Sandman ..... 428/537.1
4,888,930 A 12/1989 Kelly
4,936,071 A 6/1990 Karrfalt
4,937,992 A * 7/1990 Dawson et al. ..... 52/316
4,992,331 A 2/1991 DeCosta
5,093,185 A * 3/1992 Ungar et al. ..... 428/204
5,187,000 A * 2/1993 Chow et al. ..... 428/141
5,231,814 A 8/1993 Hageman
5,251,416 A 10/1993 White
5,270,119 A * 12/1993 Yanutola ..... 428/507
5,335,473 A * 8/1994 Chase ..... 52/745.08
5,425,976 A 6/1995 Clarke
5,515,659 A * 5/1996 MacDonald et al. ..... 52/474
5,647,934 A 7/1997 Vaders
5,661,937 A * 9/1997 Doppler et al. ..... 52/410
5,687,517 A * 11/1997 Wiercinski et al. ..... 52/177
5,700,570 A * 12/1997 Fahmy ..... 428/342
5,718,786 A 2/1998 Lindquist
5,859,114 A 1/1999 Davis
5,955,203 A 9/1999 Briggs
6,120,869 A 9/2000 Cotsakis
6,131,353 A * 10/2000 Egan ..... 52/408
6,253,530 B1 * 7/2001 Price et al. ..... 52/793.1
6,293,069 B1 9/2001 Monda
6,308,491 B1 * 10/2001 Porter ..... 52/794.1
6,355,333 B1 * 3/2002 Waggoner et al. ..... 428/174
6,434,897 B1 * 8/2002 Sievers et al. ..... 52/177
6,455,151 B1 9/2002 Sakashita
6,460,304 B1 * 10/2002 Kim ..... 52/408
6,516,580 B1 * 2/2003 Maietta ..... 52/483.1
6,673,417 B1 * 1/2004 Gudet ..... 428/156
6,675,544 B1 1/2004 Ou
6,715,249 B2 * 4/2004 Rusek et al. ..... 52/481.1
6,737,155 B1 5/2004 Ou
6,772,569 B2 8/2004 Bennett
6,800,352 B1 * 10/2004 Hejna et al. ..... 428/138
6,892,498 B1 * 5/2005 Roman ..... 52/79.5
6,925,766 B2 * 8/2005 Di Pede ..... 52/408
6,988,343 B2 * 1/2006 Gleeson et al. ..... 52/459
7,021,018 B2 * 4/2006 Peng ..... 52/549
7,155,868 B2 * 1/2007 Cole et al. ..... 52/394
7,159,368 B2 * 1/2007 Peng ..... 52/393
2001/0028943 A1 * 10/2001 Mashiko et al. ..... 428/195
2002/0018908 A1 * 2/2002 Smith et al. ..... 428/600
2003/0079431 A1 * 5/2003 Schuman et al. ..... 52/506.01
2003/0113534 A1 6/2003 Poisson
2003/0199217 A1 * 10/2003 Cashin et al. ..... 442/394
2004/0029469 A1 * 2/2004 Anderson et al. ..... 442/77
2004/0103608 A1 * 6/2004 Lionel ..... 52/408
2004/0226247 A1 11/2004 Byrd
2005/0016088 A1 * 1/2005 Pursall et al. ..... 52/177
2006/0048464 A1 * 3/2006 Suzuki et al. ..... 52/177
2006/0053737 A1 3/2006 Jaffee
2006/0053738 A1 3/2006 Jaffee
2006/0053739 A1 3/2006 Jaffee
2006/0141191 A1 * 6/2006 Seth et al. ..... 428/40.1
2007/0044397 A1 * 3/2007 Wiercinski et al. ..... 52/177
2008/0141604 A1 * 6/2008 Arthurs et al. ..... 52/408
2008/0145681 A1 * 6/2008 Toas et al. ..... 428/500
2008/0190048 A1 * 8/2008 Kitakado ..... 52/177

OTHER PUBLICATIONS

U.S. Appl. No. 60/547,031, filed Feb. 23, 2004, Bennett et al., provisional application.

Huber Engineered Woods, PerformMAX™ 500 Product Sheet (Huber Reference HUB 208), first sale date Sep. 21, 2000.

Huber Engineered Woods tri-fold pamphlets with product overview including PerformMAX™ (Huber Reference HUB 223), first sale date Sep. 21, 2000.

CoFair Products, Inc., Tite-Seal™ Self-Adhesive Waterproof Flashing Flyer, Jan. 4, 2005.

Final Office Action mailed Mar. 2, 2009, U.S. Appl. No. 11/029,300, filed Jan. 4, 2005, Title: "Wall Sheathing System and Method of Installation," First Named Inventor: John L. Bennett.

Non-Final Office Action mailed Mar. 17, 2009, U.S. Appl. No. 11/029,535, filed Jan. 4, 2005, Title: "Panel for Sheathing System and Method," First Named Inventor: John L. Bennett.

* cited by examiner

PANELIZED ROOFING SYSTEM AND METHOD

This invention claims priority benefit to U.S. patent application Ser. No. 60/547,029 filed Feb. 23, 2004, and U.S. patent application Ser. No. 60/547,031 filed Feb. 23, 2004.

FIELD OF THE INVENTION

The present invention relates to roofing systems and, more particularly, to a roofing system utilizing moisture resistant and skid resistant panels.

BACKGROUND OF THE INVENTION

The roof of a residential or commercial building is typically constructed by attaching several roofing panels to the rafters of an underlying supporting structural frame; the panels are most often placed in a quilt-like pattern with the edge of each panel contacting the edges of adjacent panels so as to form a substantially continuous flat surface atop the structural frame.

However, problems with roofs constructed according to this method may present themselves. In particular, small gaps along the edges of adjoining roofing panels remain after roof assembly. Because the roofing panels are typically installed days or even weeks before shingles are installed, it is important to have a panel system that minimizes leakage resulting from exposure to the elements until such time as the roof is completed. To prevent water from leaking through the gaps between panels, it is commonly known in the industry to put a water resistant barrier layer on top of the roofing panels (e.g., felt paper). Accordingly, there is a need in the art for roofing panels, which can be conveniently fit together and yet are constructed to minimize the gaps or allow the gaps to be sealed between adjacent roofing panels to prevent or minimize the penetration of bulk water through the roof as it travels over the roof's surface. It is desirable for roofing panels to shed precipitation, such as rain and snow, during construction so that the interior remains dry. Further, there is a need in the art for roof sheathing panels, which are moisture permeable and create a simplified, safe, and time-saving installation process by means of a surface overlay member or coating permanently bonded thereon.

While it is important that the barrier layer shed bulk water, it should also allow for the escape of water vapor. If the barrier were to trap water vapor in a roof panel, the build-up of moisture could lead to rot or mold growth that is undesirable. As mentioned previously, it is known in the art that substantial bulk water-impermeability of roofing panels may be improved by adding a layer of impermeable material, such as asphalt-impregnated roofing paper or felt over the external surface of the roof panels. However, while this provides additional protection against bulk water penetration, it has the disadvantage of being difficult and time-consuming to install because the paper or felt must be first unrolled and spread over the roof surface and then secured to those panels. Further, the use of a felt paper overlay often results in a slick or slippery surface, especially when wet. Additionally, when the felt paper is not securely fastened to the roof panels or becomes loose due to wind and other weather conditions or because of poor construction methods, the roof system can become very slippery. Accordingly, a worker walking atop the felt paper must be careful to avoid slipping or sliding while thereon. To that end, the present invention provides a panel for a roof sheathing system comprising structural panels, a mass-transfer barrier, and seam sealing means that is advantageously bulk water resistant and that exhibits adequate anti-skid characteristics.

Given the foregoing, there is a continuing need to develop improved panels for roof construction that prevent or minimize the penetration of bulk water, that come pre-equipped with a water-impermeable barrier layer applied during manufacture, and that have a skid resistant surface.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown in the drawings, and that for purposes of illustration, these figures are not necessarily drawn to scale.

DETAILED DESCRIPTION OF THE INVENTION

All parts, percentages and ratios used herein are expressed by weight unless otherwise specified. All documents cited herein are incorporated by reference.

As used herein, "wood" is intended to mean a cellular structure, having cell walls composed of cellulose and hemicellulose fibers bonded together by lignin polymer. "Wafer board" is intended to mean panels manufactured from reconstituted wood wafers bonded with resins under heat and pressure.

By "wood composite material" it is meant a composite material that comprises wood and one or more other additives, such as adhesives or waxes. Non-limiting examples of wood composite materials include oriented strand board ("OSB"), waferboard, particleboard, chipboard, medium-density fiberboard, plywood, and boards that are a composite of strands and ply veneers. As used herein, "flakes" and "strands" are considered equivalent to one another and are used interchangeably. A non-exclusive description of wood composite materials may be found in the Supplement Volume to the Kirk-Othmer Encyclopedia of Chemical Technology, pp. 765-810, 6.sup. edition.

As used herein, "structural panel" is intended to mean a panel product composed primarily of wood which, in its commodity end use, is essentially dependent upon certain mechanical and/or physical properties for successful end use performance such as plywood. A non-exclusive description may be found in the PS-2-92 Voluntary Product Standard.

The following describes preferred embodiments of the present invention which provides a panelized roofing system, attached to the rafters of a timber frame structure to form a roof, and that is suitable for use in the construction of residential and commercial buildings.

Figure 1:
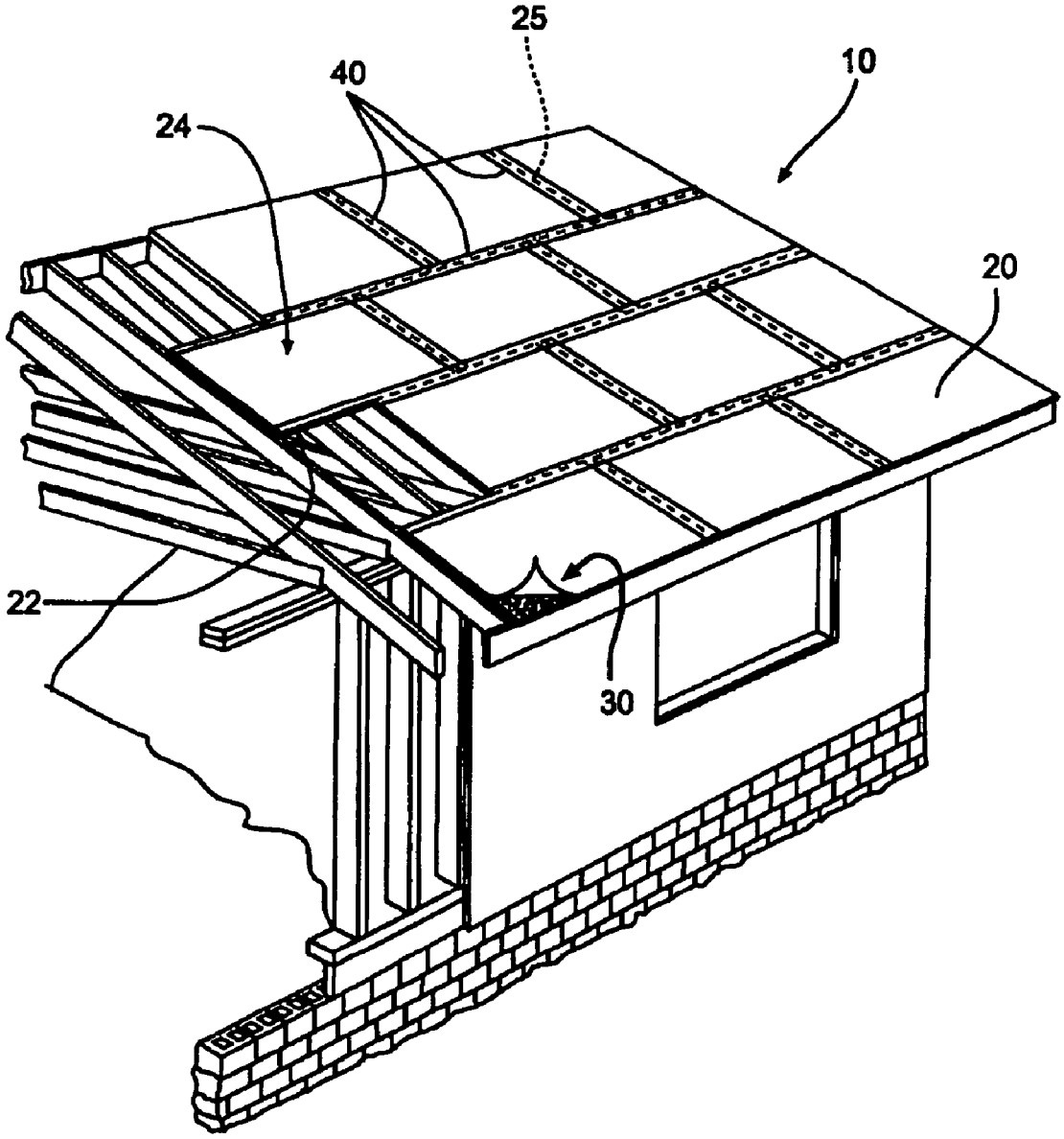
FIG. 1 is a perspective view of a panelized roofing system of the present invention.

FIG. 1 illustrates a panelized roof sheathing construction system 10 for a building having a plurality of panels 20 attached to a building frame structure in substantially abutting relationship. The panels 20 have an inward facing surface 22, an outward facing surface 24 and at least one peripheral edge. The system 10 also includes a plurality of water resistant barrier layers 30 adhesively secured to at least one of the surfaces 22, 24 of the panels 20, each barrier layer 30 providing a substantially skid-resistant and bulk water resistant surface. One example of a paper overlaid wood board is shown and described in U.S. Pat. No. 6,737,155 entitled "Paper Overlaid Wood Board and Method of Making the Same" which is incorporated herein by reference. Additionally, the system 10 preferably includes a plurality of water-resistant sealing means 40, each of the means 40 sealing at least one of the joints 25 between the adjacent panels 20.

Figure 2:
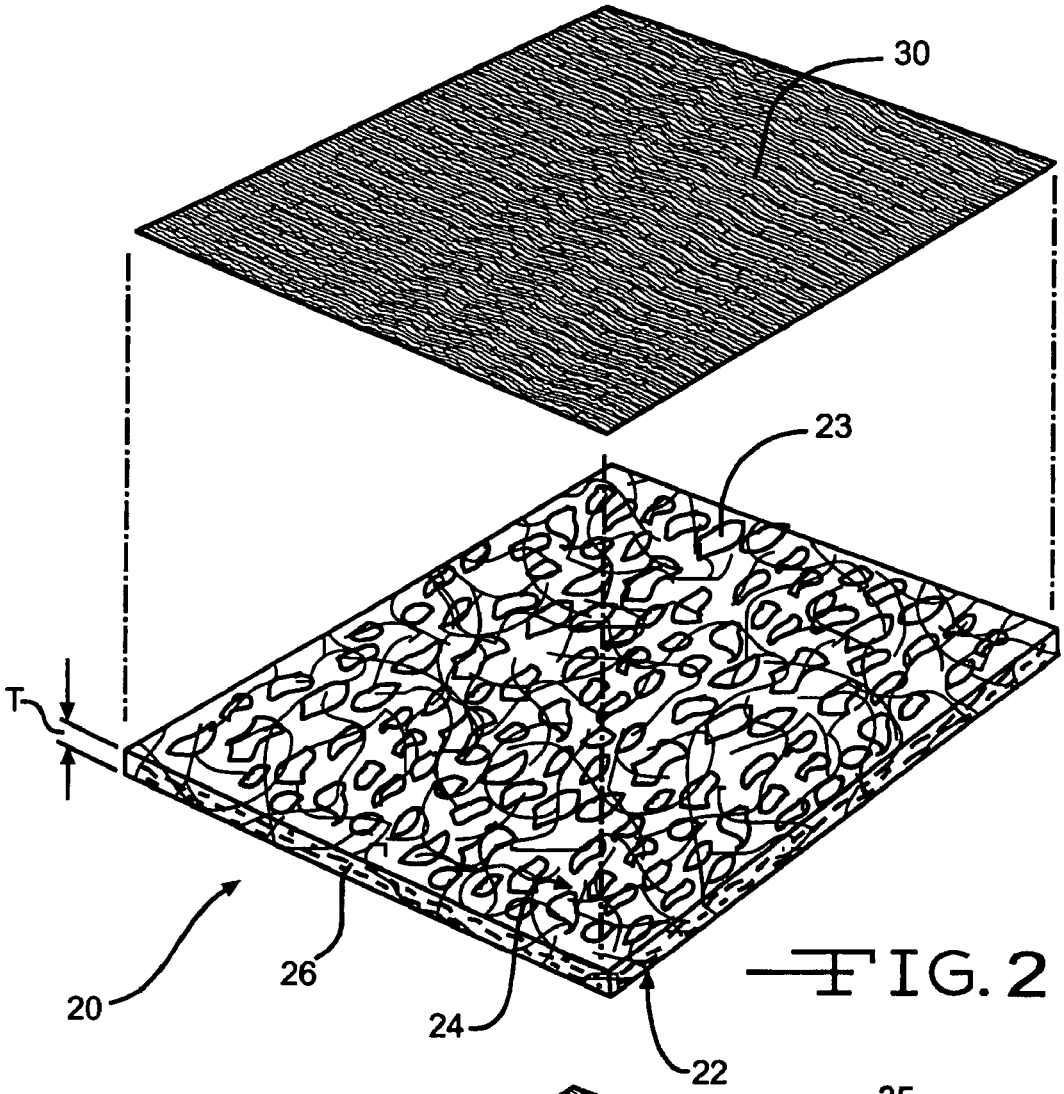
FIG. 2 is an exploded perspective view of a first embodiment of one panel of the panelized roofing system of the present invention.

The panels 20 prepared according to the present invention may be made from a variety of different materials, such as wood or wood composite materials. As shown in FIG. 2, the panels 20 are preferably comprised of an oriented strand board substrate ("OSB") having at least two surfaces 22, 24 with at least one core layer 26 disposed between them. OSB panels are derived from a starting material that is naturally occurring hard or soft woods, singularly or mixed, whether such wood is dry (preferably having a moisture content of between 2 wt % and 12 wt %) or green (preferably having a moisture content of between 30 wt % and 200 wt %) or of a moisture content in between dry and green (preferably having a moisture content of between 12 wt % and 30 wt %). Typically, the raw wood starting materials, either virgin or reclaimed, are cut into veneers, strands, wafers, flakes, or particles of desired size and shape, which are well known to one of ordinary skill in the art.

Each of the surface layers 22, 24 of the panel 20 are preferably oriented in parallel with the long dimension of the panel 20, and the oriented strand board core 26 preferably includes a plurality of substantially parallel strands 23 that are perpendicular with the surface layers 22, 24. The panels 20 of the panelized roof system 10 may be selected from a number of suitable materials that provide adequate protection against the penetration of bulk water. Preferably, the panels of the present invention are comprised of reconstituted lignocellulosic furnish. More preferably, the panels 20 are comprised of structural wood such as OSB or plywood. Types of wood material used to manufacture the panels 20 may be, but are not limited to particle board, medium density fiber board, waferboard or the like.

The presently described panels 20 are preferably of a thickness T in a range from about 0.635 cm (0.25 inches) to about 3.175 cm (1.25 inches). The panels 20 may also comprise a radiant barrier material attached to the lower face of the panel, i.e., the face of the panel facing inwardly, toward the interior of the building. The radiant barrier material preferably includes a reflective component that reflects infrared radiation that penetrates through the roof back into the atmosphere. The combination of this reflective function, as well as the foil's low emissivity, limits the heat transfer to the attic space formed in the interior of the building in the space under the roof. By limiting the heat transfer, the attic space temperature is reduced, which in turn reduces the cost of cooling the house.

The radiant barrier material may simply be a single layer radiant barrier sheet, such as metal foil, such as aluminum foil. Alternatively, the radiant barrier material may be composed of a radiant barrier sheet adhered to a reinforcing backing layer made from a suitable backing material, such as polymeric film, corrugated paper board, fiber board or Kraft paper. The backing material makes the foil material easier and more convenient to handle. The multi-layered material may be a laminate in which a backing material is laminated to a radiant barrier sheet.

Methods of manufacturing the radiant barrier material are discussed in greater detail in U.S. Pat. No. 5,231,814, issued Aug. 3, 1993 to Hageman and U.S. Pat. No. 3,041,219, issued Jun. 26, 1962, to Steck et al. Other suitable radiant barrier material is manufactured under the name SUPER R™ by Innovative Insulation, Inc. of Arlington, Tex. These SUPER R™ products have two layers of aluminum foil each of which have an aluminum purity of 99%, and a reinforcing member located inside, between the two layers. The reinforcing member may be a reinforcing scrim or a polymer fabric.

Both the radiant barrier material and the barrier layer can be applied to the panel by spreading a coat of adhesive to the surface of the panel, applying the heat-reflecting material (or the barrier layer) over the adhesive onto the panel and pressing the radiant barrier material (or barrier layer) onto the panel. After the adhesive dries or cures, the panel is ready for use.

Additionally, the radiant barrier may be a coating on either side of the panel 20, which could be used facing into or out from the attic. Additionally, some panels 20 may also provide protection against ultraviolet light per ASTM G53, G154, which does not delaminate, does not reduce slip resistance, and does not promote fading.

Figure 3:
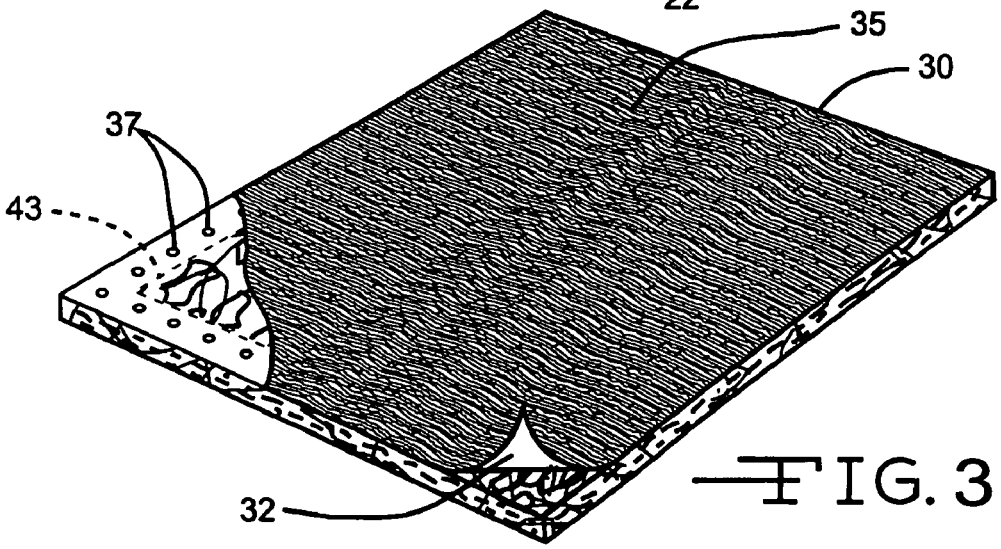
FIG. 3 is a view of a panel and barrier layer according to the roofing system of the present invention.

Referring now to FIG. 3, the panelized roof system 10 includes a plurality of barrier layers 30 each secured to the outward facing surface of one of the panels 20, with each one of the barrier layers 30 providing a substantially skid-resistant surface 35.

Figure 11:
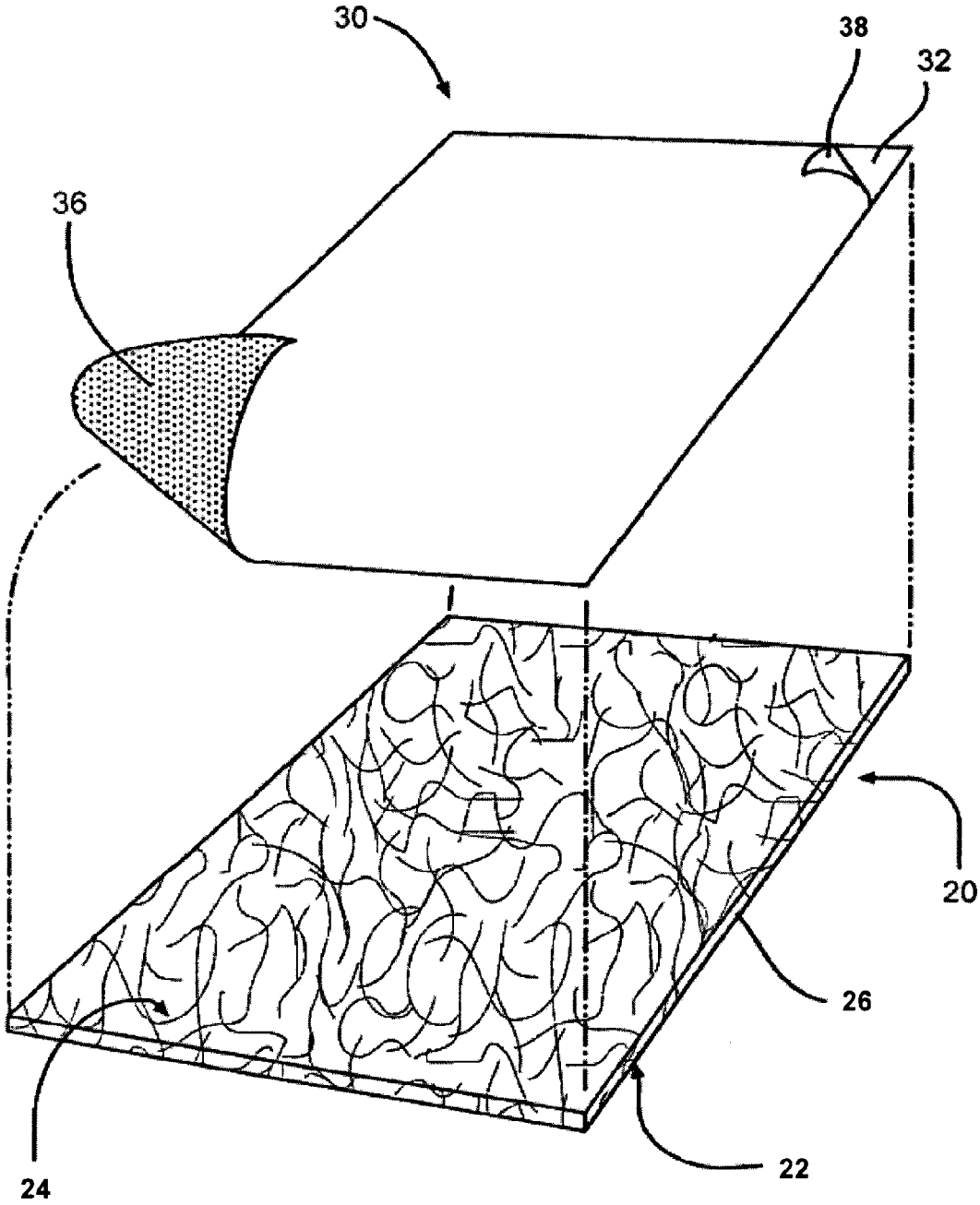
FIG. 11 is an exploded view of a panel and a barrier layer, in accordance with an exemplary embodiment.
Figure 12:
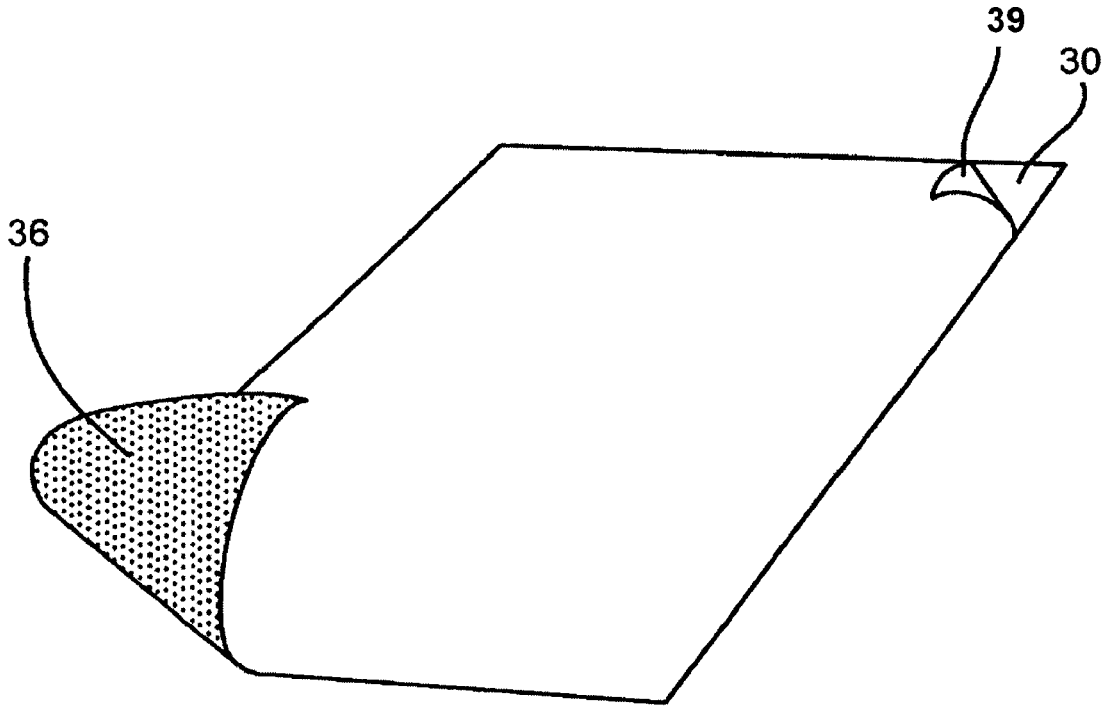
FIG. 12 is a perspective view of a barrier layer assembly, in accordance with an exemplary embodiment.

Referring to FIG. 11, barrier layer 30 may be comprised of a paper 32 with at least two sides. During the construction stage of the panels 20, a barrier layer 30 may be bonded to each panel 20 to form the barrier. The barrier layer 30 may have three parts: paper 32, at least one of a resin-overlay member or coating 38 and a glueline layer 36, each of which may affect the durability and final permeability of the panel. Referring to FIG. 12, in exemplary embodiments the barrier 30 may comprise an additional layer 39 such as a UV-resistant overlay, a radiant reflective layer or the like. These barrier layers 30 may optionally be comprised of a resin-impregnated paper 32 having a paper basis weight of 21.772 kg (48 lbs.) to about 102.058 kg (225 lbs.) per ream or a dry weight of about 78.16 gm/m$^2$ (16 lbs./msf) to about 366.75 gm/m$^2$ (75 lbs./msf), and they preferably substantially cover the outward facing surface 24 of the panels 20. The paper 32 is preferably resin-impregnated with a resin such as, but not limited to a phenol-formaldehyde resin, a modified phenol-formaldehyde resin, or other suitable resin. Preferably, the paper has a resin content of about greater than 0% to about 80% by dry weight, most preferably from a range of about 20% to about 70% by dry weight. The resin-impregnated paper adhered to panel in the panelized roof sheathing construction system 10 of the present invention also preferably includes a glueline layer 54 in a range from about 9.77 gm/m$^2$ (2 lbs./msf) to about 244.25 gm/m$^2$ (50 lbs./msf), and more preferably of a range from about 9.77 gm/m$^2$ (2 lbs./msf) to about 58.62 gm/m$^2$ (12 lbs./msf). The glueline layer 54 may be formed from a phenol-formaldehyde resin, an isocycanate, or the like.

Referring to FIG. 11, the barrier layers 30 may comprise an applied coating layer 38 of acrylic thermoset resin or other appropriate coating layer. An acrylic coating such as an experimental acrylic emulsion from Akzo-Nobel or Valspar's Black Board Coating which is asphalt based. It is understood by those skilled in the art that other classes of coatings may serve as an appropriate barrier layer. Coatings may be used with paper overlays to add the desired functions to the roof sheathing system.

These panels with barrier layers 30 are optionally characterized by water permeability in a range from about 0.1 U.S. perms to about 1.0 U.S. perms, and have a water vapor transmission rate from about 0.7 to about 7 g/m$^2$/24 hrs. (at 73° F.—50% RH via ASTM E96 procedure A), and have a water vapor permeability from about 0.1 to about 12 U.S. perms (at 73° F.—50% RH via ASTM E96 procedure B), and a liquid water transmission rate from about 1 to about 28 (grams/100 in$^2$/24 hrs via Cobb ring), per ASTM D5795. This test method allows the quantification of liquid water that passes through the underlayment to the underlying substrate and can be easily done on specimens where the underlayment cannot be removed for visual inspection.

An embodiment of this invention suggests that a non-skid surface that has a coefficient of friction equal to or better than plywood or oriented strand board when dry and/or wet can be achieved in a primary process that is both quick and relatively inexpensive. Specifically, the water-resistant barrier layers 30 of the present invention advantageously provide a textured surface 35 to the structural panels 20. Specifically, the textured surface 35 is adapted to provide a wet coefficient of friction in a range of from about 0.8 to about 1.1 (English XL Tribometer) and a dry coefficient of friction in a range of from about 0.8 to about 1.1 (English XL Tribometer). Examples of methodology used to measure wet surfaces may be found at pg. 173 in "Pedestrian Slip Resistance; How to Measure It and How to Improve It." (ISBN 0-9653462-3-4, Second Edition by William English).

Figure 4:
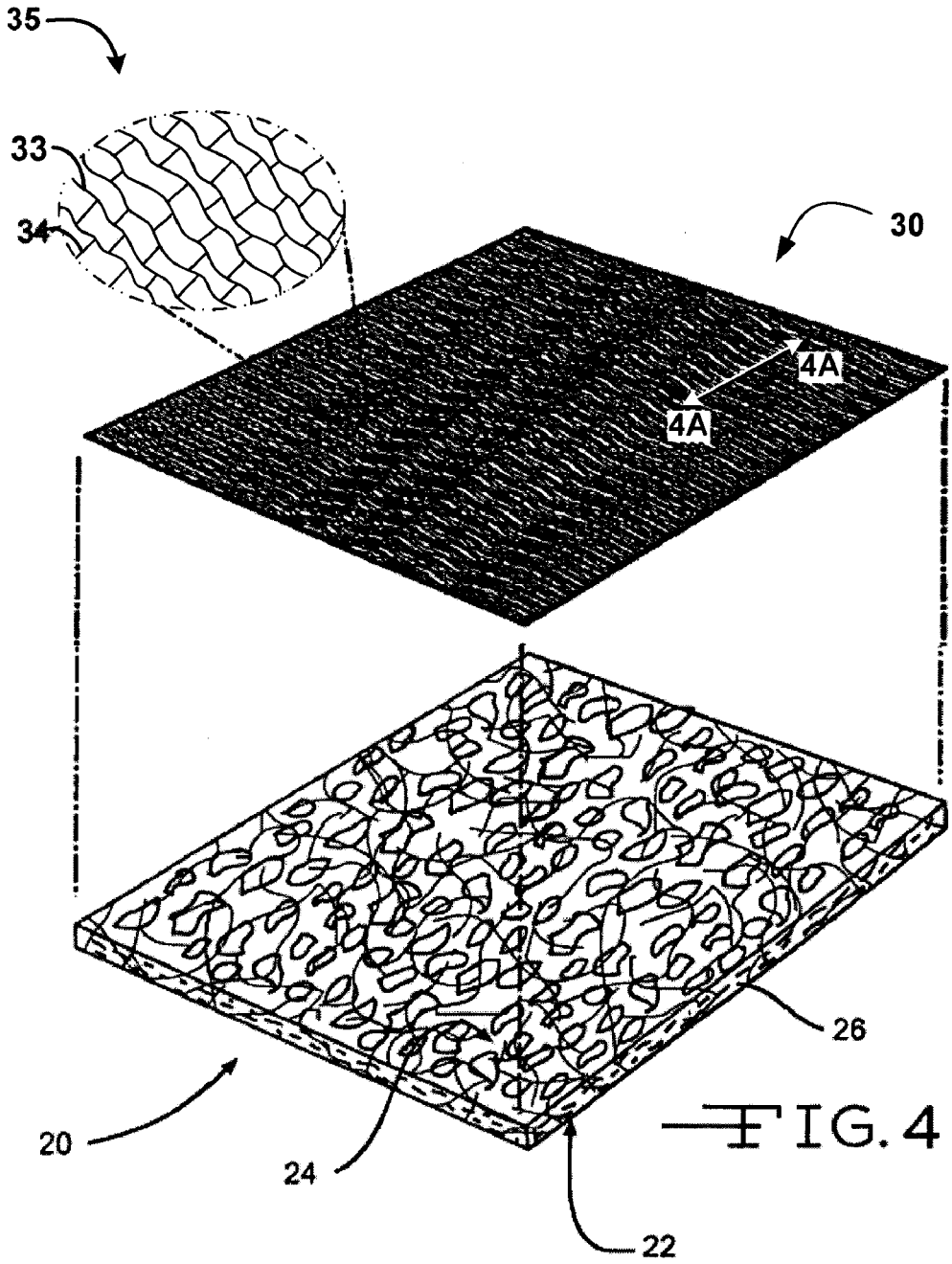
FIG. 4 is an exploded perspective view of a panel, showing a detailed exploded view of the textured surface, according to the panelized roofing system of the present invention.
Figure 4A:
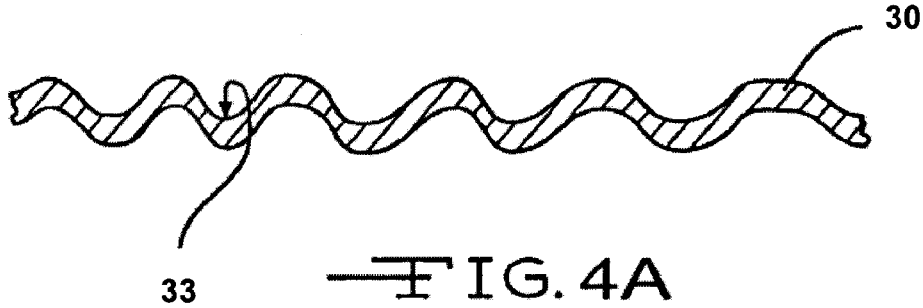
FIG. 4A is a cross-sectional view of the textured surface taken along the line 4A-4A of FIG. 4.

Referring now to FIG. 4, the textured surface 35 is characterized by an embossed pattern of features or indentations. As used herein, "embossed" can mean embossing, debossing, scoring, or any other means to alter the texture of the panel other than adding grit or the like to the surface.

The texture preferably has a number of features or elements disposed in a first direction and a number of features or elements disposed in a second direction. For example, a first group of elements may be disposed in a direction across the width of a panel and a second group of elements may be disposed in a direction along the length of a panel. These elements or features disposed in first and second directions may be of similar or may be of different sizes. The elements similarly may be of different or of similar shapes. Non-limiting examples of similarly sized features include a embossed herringbone or a embossed basketweave configuration. A herringbone pattern may be very tightly disposed or may be somewhat "spread-out" in such a manner so that major channels with minor indentations are created.

The embossed textured surface preferably is more preferably comprised of a plurality of major or primary textured features and a plurality of minor or secondary textured features. Preferably, the minor or secondary textured features are at least partially disposed on one or more corresponding major feature. To illustrate, and although the general appearance of the preferred textured surface 35 appears to be a random pattern of raised areas, a closer examination of the preferred textured surface reveals finer detail. Specifically, the preferred textured surface 35 includes a plurality of major channels 33 that are disposed substantially parallel with a pair of opposing edges (preferably the shorter pair of opposing edges) of the panel. Additionally, a plurality of minor indentations 34 are disposed within the major channels 33 and run generally orthogonally to the major channels. It should be appreciated that the exploded magnified view of FIG. 4, showing the minor indentations 34 and major channels 33 in detail, is illustrative and does not necessarily represent the preferred density of minor indentations or major channels.

Although it is within the scope of the present invention to provide for advantageous slip-resistance by providing any number of major channels, preferably, the density of the major channels is about 5 to about 15 major channels per 2.54 cm (inch) as measured in a direction perpendicular to the direction of the major channels. More preferably, the density of the major channels is about 9 to about 12 major channels per 2.54 cm (inch) as measured in a direction perpendicular to the direction of the major channels. On a typical 1.219 (4')× 2.438 m (8') sheathing panel, the major channels will preferably run generally across the 1.219 m (four-foot), or short, direction. It should be appreciated that it is not necessary nor required that the major channels be exactly parallel and may undulate slightly from side to side in a somewhat serpentine fashion rather than being straight.

Although it is within the scope of the present invention that the minor indentations 34 may vary in length and width, the minor indentations 34 have a preferably elongated shape that measures preferably about 0.0508 cm (0.020 inches) to about 0.254 cm (0.100 inches) in length and about 0.0254 cm (0.010) to about 0.254 cm (0.100 inches) wide. Although it is within the scope of the present invention to provide for advantageous slip-resistance by providing any number of minor indentations, preferably, the density of the minor indentations is about 15 to about 35 of the minor indentations per 2.54 cm (inch) as measured along the direction of the major channels. The long direction of the minor indentations preferably extends generally across the 2.438 m (eight-foot) (or long) direction of a typical panel.

In accordance with the preferred configuration of the textured surface 35, in a typical roof sheathing application using 1.219 m (4')×2.438 m (8') panels where the 2.438 m eight-foot edge of the sheathing panel is parallel to the floor of the home, the major channels 33 will generally be oriented up and down, while the long direction of the minor indentations 34 will generally run across the roof. Preferred depth of the major channels and minor indentations have been found to be in a range of about 5 to about 35 mils as measured by the Mitutoyo Surface Profiler. It should be appreciated that at least some of the major channels and minor indentations may be of a depth greater or deeper than the thickness of the paper (i.e., some of the major channels and minor indentations may be of a depth that would project into the surface of the panel).

The barrier layers 30 may further include indicia 37 for positioning fasteners (FIG. 3). U.S. Pat. App. Pub. 2003/0079431 A1 entitled "Boards Comprising an Array of Marks to Facilitate Attachment", incorporated herein by reference, provides additional detail regarding fastener indicia 37. Additionally, the barrier layers are preferably adapted to receive fasteners in a substantially moisture-proof manner.

Figure 5:
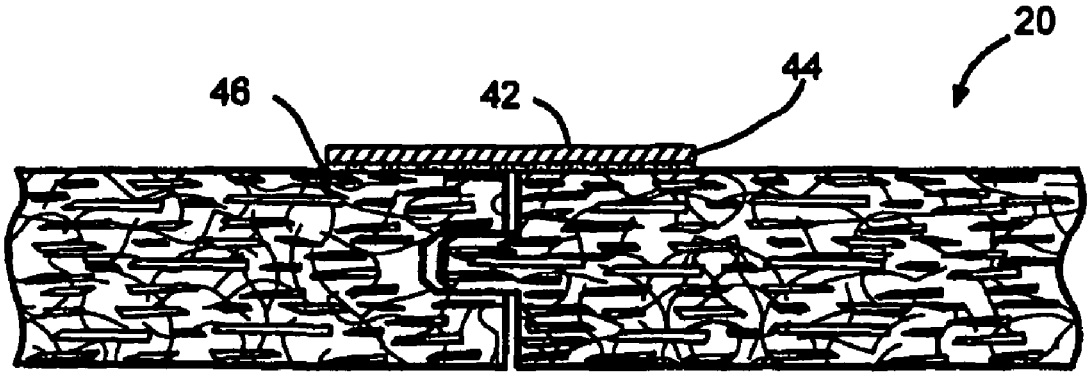
FIG. 5 is a partial cross-sectional view of two adjacent panels according to one embodiment of the system of the present invention.

FIG. 5 illustrates the cross-sectional profile of a further aspect of the panelized roof sheathing construction system 10. When attached to a building frame, joints 25 form between the panels 20. Particularly, shown is a water-resistant sealing means comprised of strips of water-resistant tape 42 with backing 44 and an adhesive layer 46. Each of the strips of tape 42 may be applied to at least one joint between adjacent panels 20 to form a substantially moisture-resistant seam with roofing accessory materials such as skylights, ventilation ducts, pipe boots, felt, flashing metals, roofing tapes, and various building substrates. The tape 42 of the present invention may have no backing or a backing 44 with a thickness of about ½ to about 1/30 the thickness of the adhesive layer 46. Optionally, the strips of tape 42 may have a backing of a thickness of about 1.0 mils to about 4.0 mils and an adhesive layer disposed on the backing of a thickness of about 2.0 mils to about 30.0 mils. The dry coefficient of friction for the tape is preferably of at least about 0.6. Alignment guides 43 for applying the tape strips 42 are also contemplated to facilitate installation as shown in FIG. 3. Preferably, the alignment guides 43 are placed approximately a distance of about ½ the width of the tape from the panel edge. The tape strips 42 are preferably installed by means of a handheld tape applicator.

In one example, the tape 42 is polyolefin (polyethylene preferred) backing of a thickness of about 2.5 mils. to about 4.0 mils. Adhesive (butyl preferred) layered deposed on said backing is of a thickness of about 8.5 mils. to about 30 mils. Where a permeable barrier is required, the tape has water vapor transmission rate (WVTR) of greater than 1.0 US perm. and possibly, as high as 200 US perms. or more.

Whether the tape 42 is impermeable or permeable to water vapor, it must be able to resist liquid water from entering into the building envelope. Since the seam tape will need to seal against the liquid water as traditional house wraps do, it is reasonable to require the tape to meet standards currently employed to measure liquid water penetration through house wraps, as would be readily known by one skilled in the art.

The technologies that are used to make films or fabrics with WVTR greater than 1.0 US Perm are well known. Tapes that have high WVTR are often used in medical applications. Permeable tapes are made from a variety of processes these tapes may be made bonding a pressure sensitive adhesive to a permeable layer. To improve strength, the permeable layer may be bonded to a woven or non-woven backing. Tapes may have in their structure permeable fabrics, coatings, membrane, or combinations thereof.

The panels 20 of the panelized roof sheathing construction system 10 preferably have a first edge which is parallel with a corresponding second edge of a panel 20 and are preferably linked together via one of a tongue 27 and groove 28 configuration, an H-clip configuration, or a mating square edge configuration, as would be understood by one skilled in the art.

Figure 6:
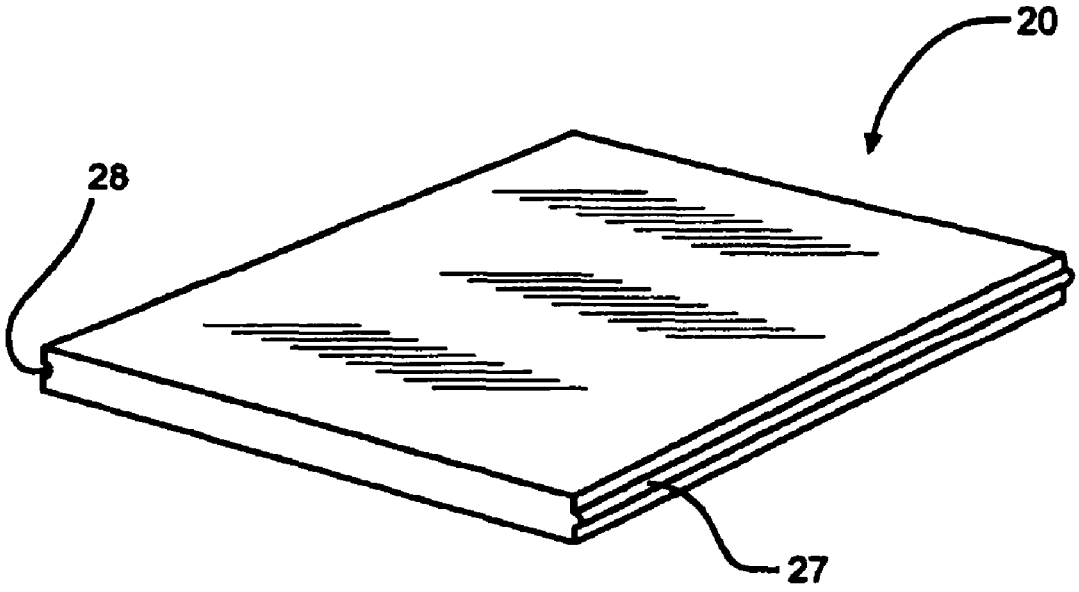
FIG. 6 is a perspective view of a panel according to one embodiment of the system of the present invention.
Figure 10A:
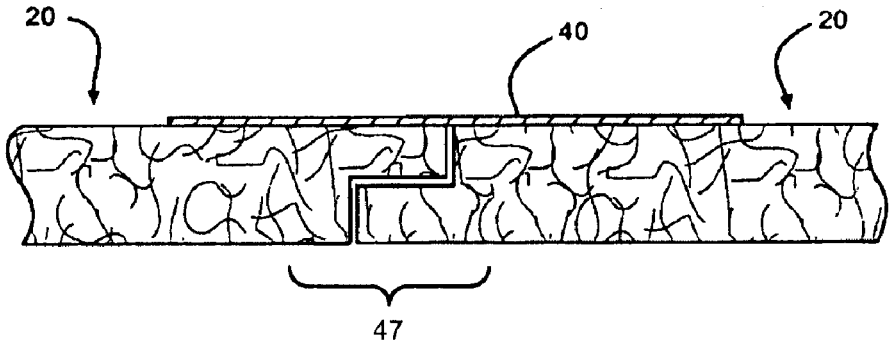
FIG. 10A is a partial cross-sectional view of two adjacent panels, in accordance with an exemplary embodiment.
Figure 10B:
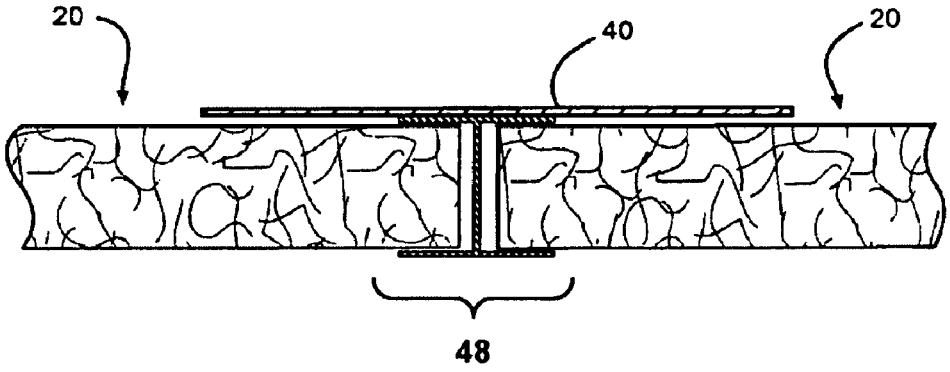
FIG. 10B is a partial cross-sectional view of two adjacent panels, in accordance with an exemplary embodiment.

Referring now to FIG. 6, each of the first and second edges preferably have contiguous sections of equal length, with each section potentially including a groove 28 and a tongue 27 compatible with a corresponding groove 28 (and tongue 27). An example of one such tongue and groove panel is shown and described in U.S. Pat. No. 6,772,569 entitled "Tongue and Groove Panel" which is incorporated herein by reference. Referring now to FIGS. 10A and 10B, it will be understood that adjacent panels 20 may be joined together in other configurations such as, for example, a ship lap configurations 47 or an H-clip configuration 48.

Another such example is shown and described in U.S. patent application Ser. No. 10/308,649 entitled "Composite Wood Board having an Alternating Tongue and Groove Arrangement along a Pair of Edges" which is incorporated herein by reference. The length of the first edge of each panel 20 is preferably a multiple of the length of a section, with the multiple being at least two. The length of the tongue 27 in each section measured in the longitudinal direction of an edge is preferably less than or equal to the length of the grooves 28, or the longest groove 28 in each section.

Figure 8:
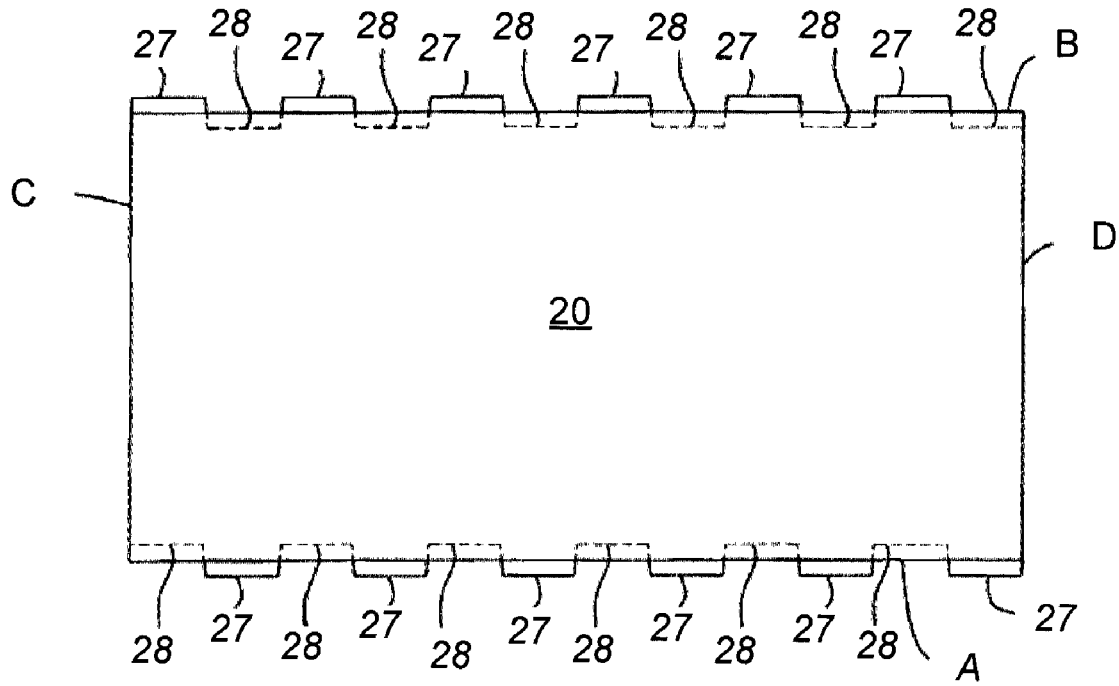
FIG. 8 is a plan view of a panel, according to the invention.

Referring to FIG. 8, panel 20 may have a first edge A, a second edge B, a third edge C and a fourth edge D. Edges A and B may be parallel. Edges C and D may be parallel and substantially perpendicular to edges A and B. Each of the edges A and B of panel 20 may include an alternating tongue and groove arrangement. Specifically, edge A includes perpendicularly extending tongues 27 and grooves 28. Edge B is similarly constructed. It includes tongues 27 and grooves 28. Edge C is in contact with tongue 27 of edge B and groove 28 of edge A. Edge D is in contact with groove 28 of edge B and tongue 27 of edge A. Thus, the tongues and grooves of panel 20 are directly opposite each other.

Figure 9A:
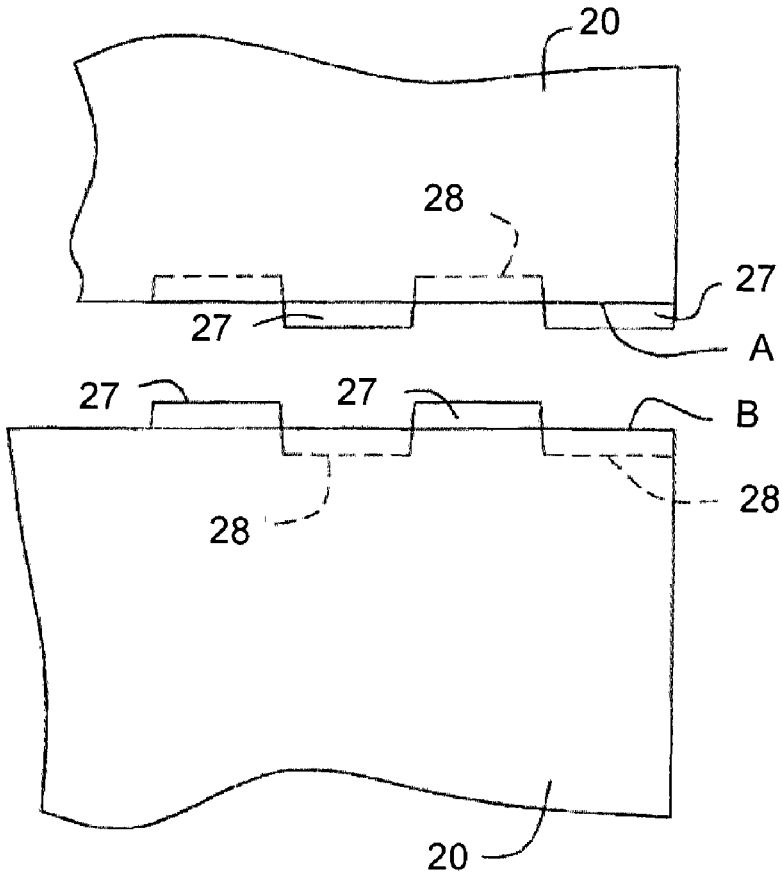
FIG. 9A is a partial plan view of a pair of panels; each according to the invention, aligned for engagement.
Figure 9B:
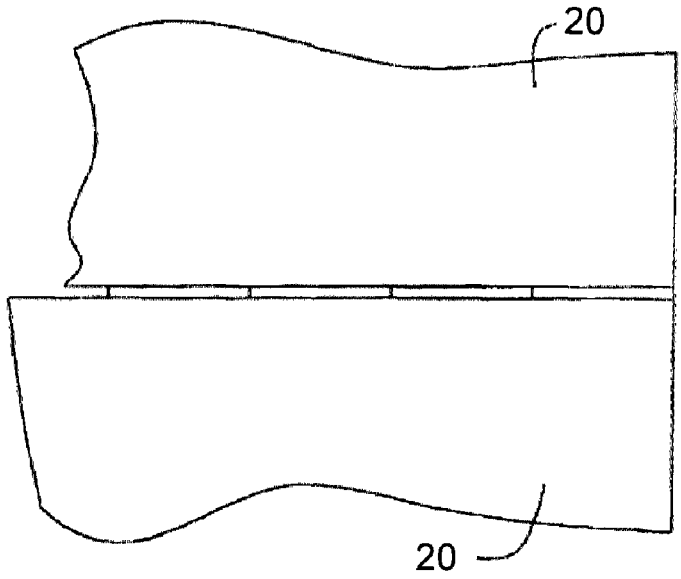
FIG. 9B is a partial plan view of a pair of panels, each according to the invention, engaged.

Referring to FIGS. 9A and 9B, the tongues 27 and grooves 28 along edge A of panel 20 can be brought into engagement with the grooves 28 and tongues 27 of edge B of adjacent panel 20. Similarly, if one of the boards 20 is rotated one hundred and eighty degrees, the tongues 27 and grooves 28 along abutting edges can be brought into engagement.

As a general summary, producing skid-resistant and water-resistant building panels of the present invention comprises the steps of providing a roll of resin-impregnated paper, feeding a leading edge of a sheet of paper from said roll of paper onto a forming belt, and depositing reconstituted lignocellulosic furnish with an applied binding agent atop the paper sheet so as to form a lignocellulosic mat having first and second lateral edges. The flake mat and the paper sheet are cut into a segment of a predetermined length. The segments are transferred onto a loading screen and then into a hot press. Sufficient heat and pressure are provided in order to set the panel structure and to form a skid-resistant surface resulting from the screen imprint on said paper. The consolidated mats are cut into panels of predetermined sizes. The paper sheet is preferably wet prior to transferring the segment onto the loading screen. Additionally, indicia 37 for positioning fasteners are preferably marked onto the panel.

As a person becomes accustomed to walking on sloped surfaces such as roof systems, a small change in the coefficient of friction can cause someone to easily lose his or her footing. This is illustrated in Table 1, which shows the coefficient of friction of plywood, OSB, those panels with securely fastened roofing felt and OSB and plywood with loose felt paper applied. The significant differences seen in the coefficient of friction of systems between felt paper being securely fastened and loose, is more than enough to cause a slipping hazard. The present system 10 has an advantage over felt paper in that the coefficient of friction does not change since the barrier layer 30 is securely fastened to the panel 20 prior to installation thus virtually eliminating the occurrence of paper coming loose in the field.

It is important that the panels used in roof applications are not slippery in service. It has also been observed that the coefficient of friction can vary among roof sheathing products of similar types from different sources. Further, the coefficient of friction of panels from one manufacturer can change dramatically, such as when the panels get wet from a change in weather conditions or morning dew. Further, the change in coefficient of friction can be inconsistent among manufacturers. This may be the result of process conditions, wood species, and raw materials used to manufacture these products.

Sanding does not improve friction for sheathing panels even though it removes a top layer of wood that may be partially degraded by the process conditions, but it does promote adhesion for secondary lamination. Flat laminated products are perceived to be more slippery than textured products, and water on many substrates makes them slippery when wet. An anti-skid coating can be added to improve the coefficient of friction, but these coatings add additional manufacturing steps, equipment, and cost. Indeed, when plywood or OSB panels are overlaid with paper to create a smooth surface, the coefficient of friction drops compared to regular plywood and OSB. Adding texture to the surface of OSB has been suggested as a method of improving friction or skid-resistance of these panels, but testing of OSB sheathing using the English XL Tribometer showed that the coefficient of friction of the smooth and textured sides of OSB were very similar under dry conditions and that the texture could decrease the coefficient of friction in the wet condition, which is shown in Table 2.

Thus, another notable advantage of the present invention is retained skid resistance when wet. When texture is added to the surface of an overlaid wood composite panel of the present invention, the coefficient of friction unexpectedly increased above that of standard plywood and OSB.

An embodiment of this record of invention suggests that a non-skid surface that has a coefficient of friction equal to or better than plywood or oriented strand board when dry and/or wet can be achieved in a primary process that is both quick and relatively inexpensive.

An embodiment of this record of invention is illustrated in Tables 3 & 4 and Plots 2 & 3, which shows the coefficient of friction of the screen imprinted overlaid panel vs. smooth overlaid panels, oriented strand board with a screen imprint, oriented strand board that has been sanded and plywood in dry and wet conditions. Paper basis weights (per ream) of 70#, 99# and 132# were also tested and compared to show that the range of paperweights mentioned in the embodiment of this record of invention will satisfy the coefficient of friction requirements.

From testing conducted using the English XL Tribometer, the coefficient of friction, as can be seen from Table 3, is significantly higher when a screen imprint is embossed on the surface of the panels as compared to the smooth surface of paper-overlaid panels. From Table 4, it can be seen that the coefficient of friction of the overlaid panels with the textured surface does no decrease much when wet and is much better than the coefficient of friction of plywood when wet.

Figure 7:
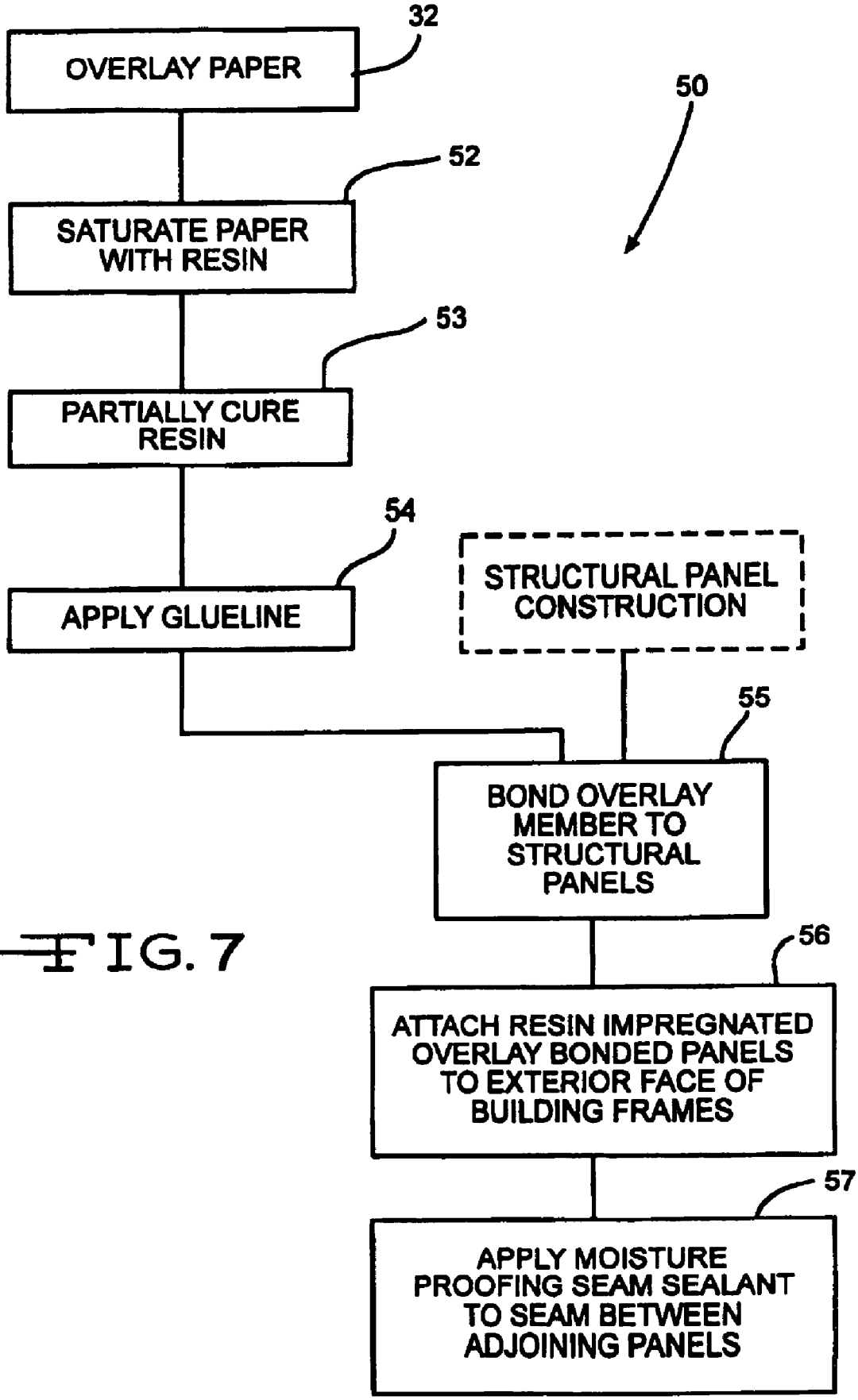
FIG. 7 is a flow diagram of the steps included in installation of a roof sheathing system method according to the present invention.

Referring now to FIG. 7 as one example of this invention, a roll of Kraft paper of 99 lb. basis weight (per ream), saturated to about 28% by weight resin content with a glue line of phenolic glue of about 10-lbs/1000 $ft^2$ applied to one side of the paper was mounted onto a paper feeding apparatus so that the paper could be fed onto the forming line of an oriented strand board.

The paper was then fed onto the forming line belt with the glue line side of the paper facing up away from the belt. To prevent wrinkling or tearing of the paper, the paper roll must be un-wound at a speed that is consistent with the speed of the forming line. To maintain complete coverage of the paper overlay onto the wood composite substrate, the paper is aligned with the forming line belt as it carries the mat toward the press.

Once the paper is fed onto the forming line, a wood mat is formed on top of the paper as it moves toward the press. The wood mat is formed with the first and second layers being the surface layers composed of strands oriented in a direction parallel to the long dimension of the panels and a third core layer composed of strands oriented in a direction perpendicular to the first and second layers.

TABLE 1

ANOVA table showing the differences in the coefficient of friction between common roofing panels of plywood and OSB and the use of felt that is securely fastened or loose on these panels. The coefficient of friction of the panel of a preferred embodiment is also shown for reference.

Analysis of Variance for CoF

| Source | DF | SS | MS | F | P |
|---|---|---|---|---|---|
| Product | 5 | 2.47230 | 0.49446 | 151.42 | 0.000 |
| Error | 66 | 0.21552 | 0.00327 | | |
| Total | 71 | 2.68782 | | | |

| Level | N | Mean | StDev | Individual 95% CIs For Mean Based on Pooled StDev |
|---|---|---|---|---|
| Embodiment 1 | 12 | 0.9043 | 0.0516 | (-*-) |
| Felt | 12 | 0.9973 | 0.0233 | (-*--) |
| Loose felt[1] | 12 | 0.5136 | 0.0323 | (-*-) |
| Loose felt[2] | 12 | 0.5646 | 0.0432 | (--*-) |
| OSB | 12 | 0.7381 | 0.0771 | (-*-) |
| plywood | 12 | 0.9360 | 0.0868 | (-*--) |

Pooled StDev = 0.0571 — 0.60 0.75 0.90

[1]Loose felt over OSB substrate.
[2]Loose felt over plywood substrate.

Figure 13:
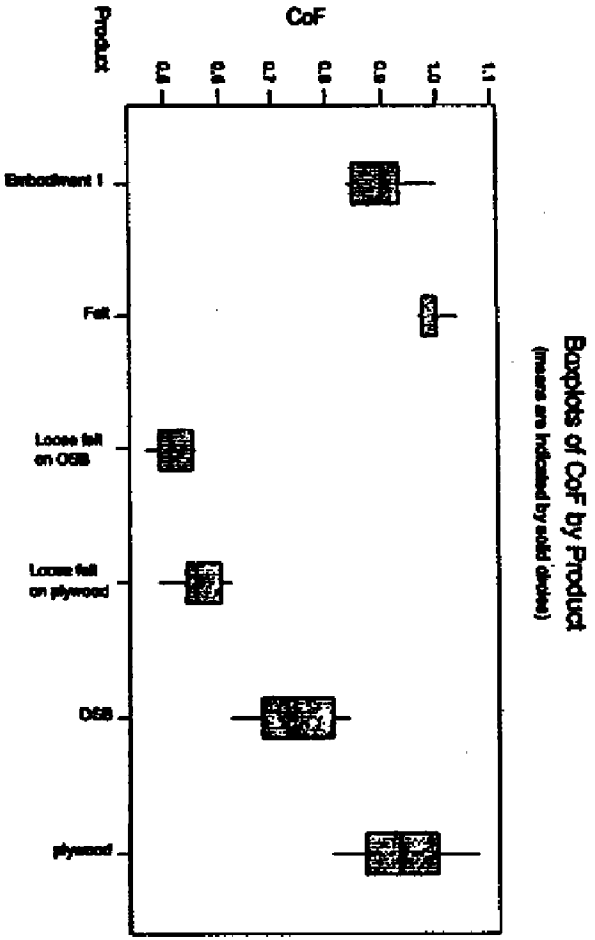
FIG. 13 is a diagram of box plots showing the differences in the coefficient of friction between paper overlaid wood composite panels with smooth and textured surfaces, oriented strand board with a textured surface, oriented strand board with a sanded surface and plywood in the dry condition.

FIG. 13 illustrates box plots showing the differences in the coefficient of friction between paper overlaid wood composite panels with smooth and textured surfaces, oriented strand board with a textured surface, oriented strand board with a sanded surface and plywood in the dry condition. "Level" is expressed as paper basis weight per ream for overlay panels. CoF=Coefficient of friction.

Figure 14:
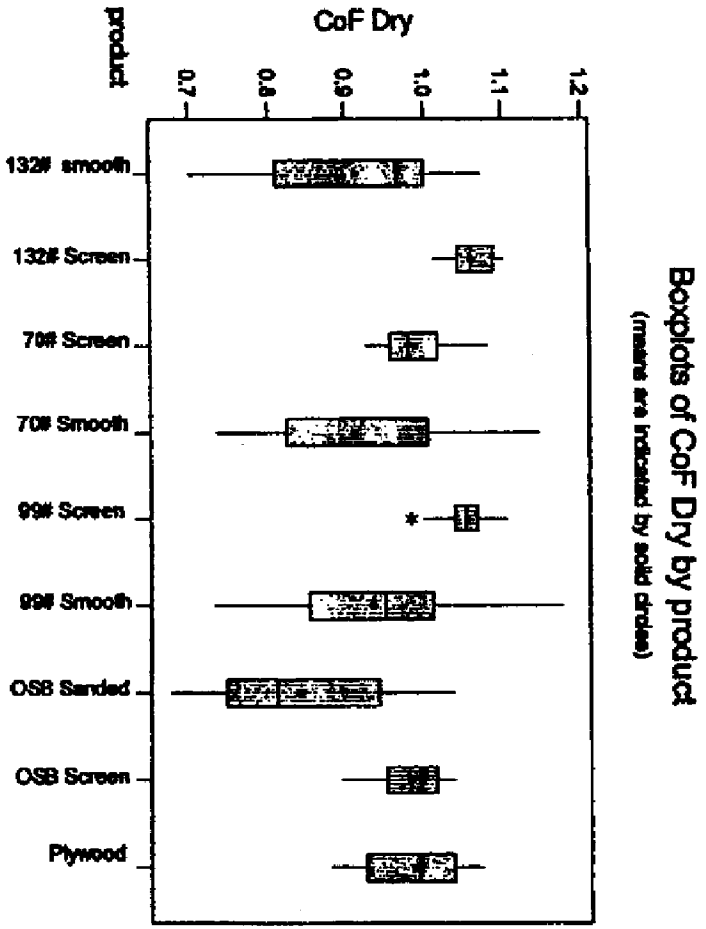
FIG. 14 is a diagram of box plots showing the differences in the coefficient of friction between paper overlaid wood composite panels with smooth and textured surfaces, oriented strand board with a textured surface, oriented strand board with a sanded surface and plywood in the dry condition.

FIG. 14 illustrates box plots showing the differences in the coefficient of friction between paper overlaid wood composite panels with smooth and textured surfaces, oriented strand board with a textured surface, oriented strand board with a sanded surface and plywood in the dry condition. "Level" is expressed as paper basis weight per ream for overlay panels. CoF=Coefficient of friction.

TABLE 2

ANOVA table showing the differences in the slip angle between the textured and smooth sides of OSB in the dry and wet condition and plywood in the wet and dry condition. The coefficient of friction is related to slip angle by CoF = Tan (slip angle), where the slip angle is expressed in radians.

| Source | DF | SS | MS | F | P |
|---|---|---|---|---|---|
| Factor | 5 | 232.33 | 46.47 | 12.46 | 0.000 |
| Error | 90 | 335.63 | 3.73 | | |
| Total | 95 | 567.96 | | | |

| Level | N | Mean | StDev | Individual 95% CIs For Mean Based on Pooled StDev |
|---|---|---|---|---|
| dry-plywood | 16 | 42.000 | 0.177 | (----*----) |
| dry-Textured | 16 | 41.500 | 0.530 | (----*---) |
| dry-Smooth | 16 | 42.063 | 0.442 | (---*----) |
| wet-plywood | 16 | 40.000 | 1.237 | (----*----) |
| wet-Textured | 16 | 37.625 | 0.530 | (----*----) |
| wet-Smooth | 16 | 39.938 | 1.326 | (----*----) |
| Pooled StDev = 0.824 | | | | 38.0 40.0 42.0 |

TABLE 3

ANOVA table showing the differences in the coefficient of friction between paper overlaid panels with a smooth surface and with a textured imprint as well as oriented strand board with a textured imprint, oriented strand board sanded and plywood in the dry condition. "Level" is expressed as paper basis weight (in lbs.) per ream for overlay panels.

Analysis of Variance for CoF Dry

| Source | DF | SS | MS | F | P |
|---|---|---|---|---|---|
| Product | 8 | 0.90809 | 0.11351 | 16.4 | 0.000 |
| Error | 177 | 1.22522 | 0.00692 | | |
| Total | 185 | 2.13331 | | | |

| Level | | N | Mean | StDev | Individual 95% CIs For Mean Based on Pooled StDev |
|---|---|---|---|---|---|
| 132 | Paper Smooth | 23 | 0.9125 | 0.1045 | (---*---) |
| 132 | Paper Textured | 20 | 1.0614 | 0.0269 | (----*---) |
| 70 | Paper Textured | 20 | 0.9882 | 0.0422 | (----*---) |
| 70 | Paper Smooth | 20 | 0.9106 | 0.1148 | (----*---) |
| 99 | Paper Textured | 20 | 1.0533 | 0.0319 | (----*---) |
| 99 | Paper Smooth | 24 | 0.9343 | 0.1079 | (---*---) |
| | OSB Sanded | 26 | 0.8391 | 0.1103 | (---*---) |
| | OSB Textured | 17 | 0.9801 | 0.0428 | (----*---) |
| | Plywood | 16 | 0.9864 | 0.0666 | (----*----) |
| Pooled StDev = 0.0832 | | | | | 0.880 0.960 1.040 |

TABLE 4

ANOVA table showing the differences in the coefficient of friction between paper overlaid wood composite panels with smooth and textured surfaces, and plywood in the wet condition. "Level" is expressed as paper basis weight per ream for overlay panels. CoF = Coefficient of friction.

Analysis of Variance for CoF Wet

| Source | DF | SS | MS | F | P |
|---|---|---|---|---|---|
| Product | 6 | 1.59735 | 0.26623 | 207.03 | 0.000 |
| Error | 136 | 0.17489 | 0.00129 | | |
| Total | 142 | 1.77224 | | | |

| Level | | N | Mean | StDev | Individual 95% CIs For Mean Based on Pooled StDev |
|---|---|---|---|---|---|
| 132 | Paper Smooth | 23 | 0.8180 | 0.0373 | (-*-) |
| 132 | Paper Textured | 20 | 1.0410 | 0.0294 | (-*-) |
| 70 | Paper Textured | 20 | 1.0125 | 0.0286 | (-*-) |
| 70 | Paper Smooth | 20 | 0.8003 | 0.0426 | (-*-) |
| 99 | Paper Textured | 20 | 1.0386 | 0.0284 | (-*-) |
| 99 | Paper Smooth | 24 | 0.8039 | 0.0432 | (*-) |
| | Plywood | 16 | 0.8882 | 0.0362 | (-*-) |
| Pooled StDev = 0.0359 | | | | | 0.800 0.880 0.960 1.040 |

Figure 15:
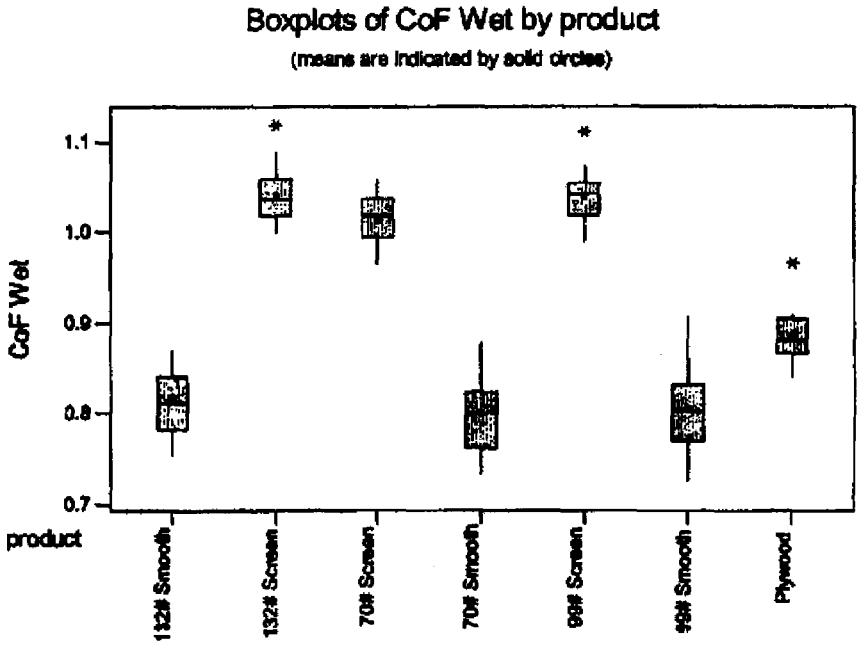
FIG. 15 is a diagram of box plots showing the differences in the coefficient of friction between paper overlaid wood composite panels with a smooth and textured surface and plywood in the wet condition.

FIG. 15 illustrates box plots showing the differences in the coefficient of friction between paper overlaid wood composite panels with a smooth and textured surface and plywood in the wet condition. "Level" is expressed as paper basis weight per ream for overlay panels. CoF=Coefficient of friction.

During this process, flakes can be pushed underneath the paper overlay and can be pressed on to the surface of the panel, giving the panel a low quality look and hindering the performance of the final product. Therefore, air wands are used at the nose of the forming line to remove the excessive flakes between the paper overlay and the forming line belt.

The mat is then cut into a predetermined size for placing into press. The cut mats are then moved over the nose on the forming line (where the flakes are removed from the paper's surface using the air wands) and picked up by a screen embossed transfer mat. If appropriate, in the production of oriented strand board, the screen embossed transfer mat is sprayed with a release agent to keep the flakes from sticking to the press. However, given that there is a Kraft paper overlay between the flakes and the mat, the release agent is not needed. To prevent the wood mat from slipping off the transfer mat during acceleration, water is sprayed on the surface of the transfer mat prior to the transfer mat picking up the wood mat.

The screen embossed transfer mat and wood mat are then placed in a hot press at a temperature preferably >360° F. for a period long enough to cure the binders on the wood flakes.

The transfer mat then moves the pressed master mat out of the press, removing the screen embossed transfer mat from the wood master mat, leaving an embossed pattern on the surface of the paper overlay. The embossed pattern has hills and valleys with a distance between the valleys and hills of preferably about 0.00254 cm (1/1000 inch) to about 0.0254

(1/1000 inch). The pattern is enough to provide needed skid resistance without puncturing the paper overlay, compromising the water-resistant quality of the panel.

Once the master mat is removed from the press, it can be cut into any dimension to meet the needs of the final user and the edges of the panels sealed with an edge seal coating.

It is understood by those skilled in the art that a continuous press could be used to manufacture overlay panels. One obvious change in the method would be that mastermats would be cut to size after leaving the press.

Another embodiment of a panel usable with the system of the present invention is a panel, useful for roof sheathing, that has improved friction under some common conditions normally found on construction sites. Specifically, the panel of the presently described embodiment was designed to achieve improved skid-resistance. As described previously, when installing a roof, it is very important that the surface of the sheathing panels need to have sufficient skid resistance so that a person exercising reasonable care can work on the angled surfaces of the roof without slippage.

Although preferable for panels to remain dry during installation, on a construction site, the panels can be subject to moisture or wetness or have sawdust or other foreign materials deposited on their surface, which can reduce the coefficient of friction (CoF) and result in undesirable slippage. Sawdust is especially common on panel surfaces as panels often need to be cut to fit the roof properly. Sawdust can be a significant problem as it may cause a reduction in the coefficient of friction of the sheathing panel surfaces. Accordingly, it is desired to remove as much sawdust as possible from the panel surfaces prior to walking thereon. Although construction workers may take some efforts to clean the sawdust off the surface of the panels using a broom, tapping the board while on the edge, or using a leaf blower, these measures often prove to be inadequate. Specifically, these sawdust removal methods do not always completely remove the sawdust from the surface. Accordingly, a panel that restores adequate skid-resistance after removing as much sawdust as possible using any suitable means or method such as those described above is desired.

Improved performance after the removal of sawdust was achieved in either of two ways. The first method of improving performance and retaining adequate friction after the removal of sawdust is to use a saturating resin in the barrier layer which has a slightly higher fraction of volatiles. The percent volatiles can be a relative reflection of the average molecular weight of the saturating resin. Accordingly, a slight change in the percent volatiles can result in a measurable change in the depth of embossing achieved in the final cure. For example, about a 6% increase in volatiles (as measured in the present experimentation from 3.5% to about 3.7% of the total weight of the resin-saturated paper, including the glueline) resulted in improved embossing in that the measured depth of at least some of the embossed features was measured to be deeper. A thorough discussion of the overlay technology, including the measurement of volatiles, is found in U.S. Pat. No. 5,955,203.

The second method of improving the frictional characteristics of the panel after the removal of sawdust was to change the type of wood furnish used to manufacture the paper in the paper overlay. It was discovered that changing the furnish used in the manufacture of the barrier layer from the typically used hardwood species to softwood species improved the retaining of friction after removal of sawdust.

To measure the friction in the presence of sawdust for the present embodiment, the coefficient of friction was measured using the English XL Tribometer. The standard techniques for using this equipment are described in ASTM F1679-04 and "Pedestrian Slip Resistance; How to Measure It and How to Improve It." (ISBN 0-9653462-3-4, Second Edition by William English). The standard methods were used to compare the various test surfaces and conditions. To test the sheathing panels with sawdust, the amount of sawdust deposited on the surface of a panel near a saw cut was measured. The sawdust deposited on a panel surface was measured by placing sheets of paper on the surface of a panel and making cuts at the edge of the paper using a circular saw with a new blade. The amount of sawdust produced by the saw was under these conditions was 2.5 g/ft$^2$. The sawdust had a size distribution as shown in Table 6 (Runs 1-4: 20 g samples; Run 5: 60 g sample; all 15 min. on vibration screen shaker.) That amount of sawdust was applied to and spread across the test specimen surface evenly as possible, then the CoF was measured using the English XL Tribometer. The sawdust was removed by tilting on its edge and tapping it with a hammer to "knock" the sawdust off and the specimen's CoF in this state was then measured. The wet condition was measured according to the procedure described at pg. 173 in "Pedestrian Slip Resistance; How to Measure It and How to Improve It." Since CoF can change depending on the surface, water was added in doses of about 1.54 g of water per test strike until the CoF remained constant. The CoF was measured for several configurations of sheathing panels and compared to existing sheathing materials as controls. The data is reported in Table 5.

The overlay panel has a texture on the surface that imparts a satisfactory CoF on the exterior surface of the panel. As described previously in the prior described panel embodiment, the texture results from pressing a screen into the surface of the panel and comprised major channels and minor indentations. The screen pattern is not symmetric, but has large channels that are roughly orthogonal to much smaller channels that are inside the larger channels. Ideally, the larger channels run up and down and the smaller channels run side to side when the panel is installed on a roof. It was found that a small difference in CoF was measured depending on the test direction. The average of four measurements (N, E, S, and W) is reported and the testing shown in the following tables was initiated so that the first measurement was taken with respect to the textured surface. N and S is measured along the direction of the major channels and E and W is measured generally orthogonally with the major channels. It was noted that some very small differences in CoF could be measured depending on the axis (N-S vs. E-W) along which the measurements were taken. It is also expected that the conditions under which the test is conducted will have some affect on the measured CoF. Variations in temperature and humidity may also have an affect on the measured CoF.

The texture preferably has a number of features or elements disposed in a first direction and a number of features or elements disposed in a second direction. These elements or features disposed in first and second directions may be of similar or may be of different sizes. The elements similarly may be of different or of similar shapes. Non-limiting examples of similarly sized features include a embossed herringbone or a embossed basketweave configuration. A herringbone pattern may be very tightly disposed or may be somewhat "spread-out" in such a manner so that major channels with minor indentations are created.

The embossed textured surface preferably is more preferably comprised of a plurality of major or primary textured features and a plurality of minor or secondary textured features. Although the general appearance of the preferred textured surface 35 appears to be a random pattern of raised areas, however, a closer examination of the preferred textured surface reveals finer detail. Specifically, the preferred textured surface 35 includes a plurality of major channels 33 that are disposed substantially parallel with a pair of opposing edges (preferably the shorter pair of opposing edges) of the panel. Additionally, a plurality of minor indentations 34 are disposed within the major channels 33 and run generally orthogonally to the major channels. Although it is within the scope of the present invention to provide for advantageous slip-resistance by providing any number of major channels, preferably, the density of the major channels is about 5 to about 15 major channels per 2.54 cm (inch) as measured in a direction perpendicular to the direction of the major channels. More preferably, the density of the major channels is about 9 to about 12 major channels per 2.54 cm (inch) as measured in a direction perpendicular to the direction of the major channels. On a typical 1.219 m (4')×2.438 m (8') sheathing panel, the major channels will preferably run generally across the 1.219 m four-foot or short direction. It should be appreciated that it is not necessary nor required that the major channels be exactly parallel and may undulate slightly from side to side in a somewhat serpentine fashion rather than being straight.

Although it is within the scope of the present invention that the minor indentations 34 may vary in length and width, the minor indentations 34 have a preferably elongated shape that measures preferably about 0.508 cm (0.020 inches) to about 0.254 cm (0.100 inches) in length and about 0.0254 cm (0.010 inches) to about 0.254 cm (0.100inches) wide. Although it is within the scope of the present invention to provide for advantageous slip-resistance by providing any number of minor indentations, preferably, the density of the minor indentations is about 15 to about 35 of the minor indentations per inch as measured along the direction of the major channels. The long direction of the minor indentations preferably extends generally across the 2.438 m (eight-foot) (or long) direction of a typical panel.

In accordance with the preferred configuration of the textured surface 35, in a typical roof sheathing application using 1.219 m (4')×2.438 m (8') panels where the 2.438 m (eight-foot) edge of the sheathing panel is parallel to the floor of the home, the major channels 33 will generally be oriented up and down, while the long direction of the minor indentations 34 will generally run across the roof. Preferred depth of the major channels and minor indentations have been found to be in a range of about 5 to about 35 mils as measured by the Mitutoyo Surface Profiler. It should be appreciated that at least some of the major channels and minor indentations may be of a depth greater or deeper than the thickness of the paper (i.e., some of the major channels and minor indentations may be of a depth that would project into the surface of the panel).

For preparation of the test panels for the presently described embodiment, the overlay papers were bonded to mats in a primary process either in the lab or on the regular manufacturing line. Then, test specimens were cut from these panels. The conditions used to prepare the test panels in the laboratory were approximately: Press time: 5 minutes; Press temp: 200 C; panel dimensions: 15.24 cm×40.64 cm×1.27 cm (6"×16"×0.5") thick; target density: 41.5 pcf; wood species: mixtures of pine; resin loading: face; MDI@4%; PPF@2% Core; MDI@4.5%; and wax loading: 2%.

TABLE 5

The CoF data for improved sheathing panels.

| Specimen | Condition | Average CoF | N-S CoF | E-W CoF |
|---|---|---|---|---|
| Softwood overlay paper | | | | |
| | Dry | 0.83 | 0.79 | 0.87 |
| | Wet | 0.77 | 0.76 | 0.78 |
| | Sawdust | 0.48 | 0.47 | 0.47 |
| | After Sawdust | 0.85 | 0.77 | 0.92 |
| High volatiles overlay | | | | |
| | Dry | 0.83 | 0.79 | 0.86 |
| | Wet | 0.82 | 0.83 | 0.81 |
| | Sawdust | 0.42 | 0.41 | 0.43 |
| | After Sawdust | 0.83 | 0.80 | 0.85 |
| OSB | | | | |
| | Dry | 0.86 | 0.84 | 0.87 |
| | Wet | 0.80 | 0.80 | 0.80 |
| | Sawdust | 0.54 | 0.51 | 0.58 |
| | After Sawdust | 0.72 | 0.73 | 0.71 |
| Plywood | | | | |
| | Dry | 1.0 | >1 | >1 |
| | Wet | 0.84 | 0.83 | 0.85 |
| | Sawdust | 0.53 | 0.54 | 0.52 |
| | After Sawdust | 0.62 | 0.61 | 0.63 |

The measurements in Table 5 were taken under conditions of higher temperature and humidity as compared with earlier described testing conditions.

TABLE 6

Particle size distribution of sawdust used to measure CoF.

| Sieve No. | Opening size (in microns) | Run #1 | Run #2 | Run #3 | Run #4 | Run #5 |
|---|---|---|---|---|---|---|
| 18 | 1000 | 0.19 | 0.21 | 0.19 | 0.18 | 0.47 |
| 30 | 600 | 0.6 | 0.83 | 0.68 | 0.58 | 2.17 |
| 60 | 250 | 3.44 | 4.57 | 3.42 | 3.40 | 9.90 |
| 80 | 180 | 3.53 | 3.15 | 2.98 | 2.72 | 8.76 |
| 100 | 150 | 1.30 | 2.52 | 4.28 | 1.17 | 3.10 |
| 140 | 106 | 4.71 | 5.13 | 3.23 | 2.32 | 9.78 |
| 200 | 75 | 1.12 | 1.54 | 1.79 | 2.28 | 6.48 |
| 325 | 45 | 4.07 | 1.55 | 4.11 | 3.87 | 10.79 |
| pan | 0 | 0.57 | 0.07 | 1.92 | 2.97 | 8.00 |

While the present invention has been described with respect to several embodiments, a number of design modifications and additional advantages may become evident to persons having ordinary skill in the art. While the illustrative embodiments have been described in considerable detail, it is not the intention of the applicant to restrict or in any way limit the scope of the appended claims.

What is claimed is:

1. A panelized roof sheathing construction system for a building comprising:

building frame structure;

a plurality of wood or wood composite panels attached to said frame structure in substantially abutting relationship so as to form joints therebetween, each one of said plurality of panels further comprising a first inward facing surface, a second outward facing surface and a peripheral edge;

each one of said plurality of panels comprising a substantially bulk water resistant barrier layer secured to at least the second outward facing surface of said panel by an adhesive layer, said plurality of substantially bulk water resistant barrier layer further comprising a substantially skid resistant embossed textured outward facing surface;

a plurality of water-resistant sealing means, each of said means sealing at least one of said joints between adjacent panels; and wherein said panels with substantially bulk water resistant barrier layers are characterized by a water permeability in the range from about 0.1 U.S. perms to about 1.0 U.S. perms as determined by ASTM E96 procedure A, and further wherein said panels with substantially bulk water resistant barrier layers are characterized by a water vapor transmission rate from about 0.7 to about 7 grams/$m^2$/24 hrs as determined by ASTM E96 procedure A (at 73° F.—50% RH), a water vapor permeability from about 0.1 to about 12 perms as determined by ASTM E96 procedure B (at 73° F.—100% RH), and a liquid water transmission rate from about 1 to about 28 grams/100 $in^2$/24 hrs via Cobb ring according to the test method described in ASTM D5795.

2. The panelized roof sheathing construction system of claim 1 wherein said skid resistant textured outward facing surface comprises a plurality of major textured features and a plurality of minor textured features.

3. The panelized roof sheathing construction system of claim 2 wherein said plurality of major textured features are disposed in a first direction and wherein said plurality of minor textured features are disposed in a second direction.

4. The panelized roof sheathing construction system of claim 3 wherein each of said plurality of major textured features is larger than each of said plurality of minor textured features.

5. The panelized roof sheathing construction system of claim 4 wherein said plurality of major textured features comprise a plurality of major channels and wherein said plurality of minor textured features comprises a plurality of minor indentations.

6. The panelized roof sheathing construction system of claim 3 wherein said first direction and said second direction are substantially orthogonal to one another.

7. The panelized roof sheathing construction system of claim 5 wherein said major channels are substantially parallel.

8. The panelized roof sheathing construction system of claim 5 wherein said major channels are continuous.

9. The panelized roof sheathing construction system of claim 5 wherein said major channels are discontinuous.

10. The panelized roof sheathing construction system of claim 5 wherein said major channels are characterized by an undulating configuration.

11. The panelized roof sheathing construction system of claim 5 wherein said major channels have a width of about 0.1694 cm (0.0667 inches) to about 0.508 cm (0.200 inches).

12. The panelized roof sheathing construction system of claim 5 wherein said major channels have a depth of about 5 to about 20 mils.

13. The panelized roof sheathing construction system of claim 5 wherein said plurality of minor indentations are disposed substantially orthogonally with said major channels.

14. The panelized roof sheathing construction system of claim 13 wherein said minor indentations have a substantially elongated configuration.

15. The panelized roof sheathing construction system of claim 13 wherein said minor indentations are of a length of about 0.0508 cm (0.020 inches) to about 0.254 cm (0.100 inches).

16. The panelized roof sheathing construction system of claim 13 wherein said minor indentations are of a width of about 0.0254 cm (0.010 inches) to about 0.254 cm (0.100 inches).

17. The panelized roof sheathing construction system of claim 13 wherein said minor indentations are of a density of about 10 to about 35 indentations per inch as measured in a direction parallel with said major channels.

18. The panelized roof sheathing construction system of claim 13 wherein said minor indentations are at least partially disposed on one or more of a corresponding major channel.

19. The panelized roof sheathing construction system of claim 1 wherein one or more of said plurality of panels is comprised of reconstituted lignocellulosic furnish.

20. The panelized roof sheathing construction system of claim 19 wherein one or more of said plurality of panels further comprises a structural panel.

21. The panelized roof sheathing construction system of claim 20 wherein one or more of said plurality of panels further comprises oriented strand board.

22. The panelized roof sheathing construction system of claim 20 wherein one or more of said plurality of panels is comprised of plywood.

23. The panelized roof sheathing construction system of claim 19 wherein one or more of said plurality of panels is comprised of particleboard.

24. The panelized roof sheathing construction system of claim 19 wherein one or more of said plurality of panels is comprised of medium density fiber board.

25. The panelized roof sheathing construction system of claim 20 wherein one or more of said plurality of panels is comprised of waferboard.

26. The panelized roof sheathing construction system of claim 1 wherein said plurality of water-resistant sealing means comprises a plurality of strips of water-resistant tape, said strips of tape comprising a backing and an adhesive layer and further wherein the thickness of said backing is from about ½ to about 1/30 the thickness of said adhesive layer.

27. The panelized roof sheathing construction system of claim 1 wherein said plurality of strips of water-resistant tape comprises a backing of a thickness of about 1.0 mils to about 4.0 mils and an adhesive layer disposed on said backing of a thickness of about 2.0 mils to about 30.0 mils.

28. The panelized roof sheathing construction system of claim 26 wherein said strips of tape have a dry coefficient of friction of at least about 0.6.

29. The panelized roof sheathing construction system of claim 1 wherein each of said panels is of a thickness in a range from about 0.635 cm (0.25 inches) to about 3.175 cm (1.25 inches).

30. The panelized roof sheathing construction system of claim 1 wherein each of said barrier layers substantially covers the entire outward facing surface of a corresponding one of said panels.

31. The panelized roof sheathing construction system of claim 29 wherein said barrier layers are comprised of a paper having a dry weight of about 75.05 g/$m^2$ (16 lbs./msf) to about 365.85 g/$m^2$(75 lbs./msf).

32. The panelized roof sheathing construction system of claim 31 wherein said paper comprises resin-impregnated paper having a resin content up to about 80% by dry weight, in a preferred range of about 20% to about 70% by dry weight.

33. The panelized roof sheathing construction system of claim 1 wherein said water resistant barrier layer further comprises an applied coating layer.

34. The panelized roof sheathing construction system of claim 33 wherein said coating layer comprises an acrylic resin.

35. The panelized roof sheathing construction system of claim 33 wherein said coating layer comprises an asphalt base.

36. The panelized roof sheathing construction system of claim 1 wherein said system further comprises a UV-resistant overlay.

37. The panelized roof sheathing construction system of claim 1 wherein one or more of said plurality of panels further comprises a radiant reflective layer.

38. The panelized roof sheathing construction system of claim 32 wherein said resin impregnated paper comprises a glueline layer in a range up to about 243.90 g/m$^2$(50 lbs./msf).

39. The panelized roof sheathing construction system of claim 38 wherein said resin-impregnated paper comprises a glueline layer of a preferred range from about 9.75 g/m$^2$ (2 lbs./msf) to about 58.53 g/m$^2$(12 lbs./msf).

40. The panelized roof sheathing construction system of claim 39 where said glueline layer comprises at least one of a phenol-formaldehyde resin, a hot-melt, and a PVA resin.

41. The panelized roof sheathing construction system of claim 39 where said glueline layer is isocyanate based.

42. The panelized roof sheathing construction system of claim 26 wherein each of said strips of tape is applied by a tape applicator to at least one joint between adjacent panels to form a substantially moisture-resistant seam.

43. The panelized roof sheathing construction system of claim 42 wherein at least some of said strips of tape form a moisture-resistant seam with roofing accessory materials.

44. The panelized roof sheathing construction system of claim 32 wherein said barrier layers are adapted to receive fasteners in a substantially moisture resistant manner.

45. The panelized roof sheathing construction system of claim 1 wherein said water-resistant barrier layer comprises a textured surface, said textured surface adapted to provide a wet coefficient of friction that is substantially the same or better than the dry coefficient of friction of said textured surface.

46. The panelized roof sheathing construction system of claim 1 wherein said textured surface is adapted to provide a wet coefficient of friction in a range of from about 0.8 to about 1.1 as measured by an English XL Tribometer per ASTM F1679-04 and said textured surface adapted to provide a dry coefficient of friction of at least about 0.8 as measured by an English 5 XL Tribometer per ASTM F1679-04.

47. The panelized roof sheathing construction system of claim 1 wherein said skid-resistant surface is an anti-skid coating.

48. The panelized roof sheathing construction system of claim 1 wherein adjacent panels are linked together via at least one of a tongue and groove configuration, a ship lap configuration, an H-clip configuration, or a mating square edge configuration.

49. The panelized roof sheathing construction system of claim 46 wherein a first edge of a panel is parallel with a corresponding second edge of a panel, each of said first and second edges having contiguous sections of equal length, each section having a groove and a tongue compatible with a corresponding groove and tongue.

50. The panelized roof sheathing construction system of claim 49 wherein the length of the first edge of each panel is a multiple of the length of a section.

51. The panelized roof sheathing construction system of claim 50 wherein the length of the tongue in each section measured in the longitudinal direction of an edge is less than or equal to the length of the grooves in each section.

52. The panelized roof sheathing construction system of claim 51 wherein a third edge and a fourth edge of each of said panels are parallel.

53. The panelized roof sheathing construction system of claim 52 wherein the first and second edges of a panel are substantially perpendicular with adjacent third and fourth edges, and further wherein in each panel the grooves and tongues of the sections of the first edge are alternately disposed with a groove adjacent the third edge and a tongue adjacent the fourth edge; and the grooves and tongues of the sections of the second edge are alternately disposed with a tongue adjacent the third edge and groove adjacent the fourth edge.

54. The panelized roof sheathing construction system of claim 53, wherein the length of the tongue in each section measured in the longitudinal direction of an edge is less than or equal to the longest grooves in each section.

55. The panelized roof sheathing construction system of claim 54, wherein the length of the tongue in each section is at most ½ the length of the length of the longest grooves in each section.

56. The panelized roof sheathing construction system of claim 1 wherein each water-resistant barrier layer further comprises indicia for positioning fasteners, said fasteners being adapted to secure said panels on said building frame structure.

57. The panelized roof sheathing construction system of claim 56 wherein said indicia further comprises alignment guides for applying said strips of tape.

58. A method for drying-in a building prior to applying roofing shingles comprising the steps of:

attaching a plurality of panels to a building frame structure, each of said panels comprising lignocellulosic material and further comprising an inward facing surface, an outward facing surface and a peripheral edge, said panels further each comprising a barrier layer adhesively secured to the outward facing surface of said panel by an adhesive layer, said barrier layer further comprising a substantially bulk water resistant and a substantially skid resistant embossed textured outward facing surface; and further wherein said barrier layers are comprised of resin-impregnated paper having a basis weight of about 78.05 g/m$^2$(16 lbs./msf) to about 365.85 g/m$^2$ (75 lbs./msf; and further wherein said panels with said barrier layers are characterized by water permeability in a range from about 0.1 U.S. perms to about 1.0 U.S. perms as determined by ASTM E96 procedure A, and further wherein said panels with said barrier layers are characterized by a water vapor transmission rate from about 0.7 to about 7 grams/m$^2$/24 hrs as determined by ASTM E96 procedure A (at 73° F.—50% RH), a permeability from about 0.1 to about 12 perms as determined by ASTM E96 procedure B (at 73° F.—100% RH), and a liquid water transmission rate from about 1 to about 28 grams/100 in$^2$ /24 hrs via Cobb ring according to the test method described in ASTM D5795;

said panels attached atop said building frame structure in substantially abutting relationship so as to form joints therebetween; and sealing the joints between adjacent panels with lengths of tape each of said lengths of tape overlapping at least one of said joints between adjacent panels, said tape comprising a backing and an adhesive layer disposed on said backing.

* * * * *

UNITED STATES PATENT AND TRADEMARK OFFICE

CERTIFICATE OF CORRECTION

PATENT NO. : 7,721,506 B2
APPLICATION NO. : 11/029293
DATED : May 25, 2010
INVENTOR(S) : Bennett et al.

It is certified that error appears in the above-identified patent and that said Letters Patent is hereby corrected as shown below:

In column 5, line 46, delete "water permeability" and insert -- water vapor permeance -- therefor.

In column 5, lines 49-50, delete "water vapor permeability" and insert -- water vapor permeance -- therefor.

In column 7, lines 54-55, delete "water vapor transmission rate (WVTR)" and insert -- water vapor permeance -- therefor.

In column 7, line 65, delete "WVTR" and insert -- water vapor permeance -- therefor.

In column 7, line 66, delete "WVTR" and insert -- water vapor permeance -- therefor.

In column 17, line 8, in Claim 1, delete "water permeability" and insert -- water vapor permeance -- therefor.

In column 17, line 15, in Claim 1, delete "water vapor permeability" and insert -- water vapor permeance -- therefor.

In column 17, line 17, in Claim 1, delete "100% RH" and insert -- 50% RH -- therefor.

In column 20, line 43, in Claim 58, delete "water permeability" and insert -- water vapor permeance -- therefor.

In column 20, lines 49-50, in Claim 58, delete "permeability" and insert -- water vapor permeance -- therefor.

In column 20, line 51, in Claim 58, delete "100%" and insert -- 50% -- therefor.

Signed and Sealed this
Twelfth Day of February, 2013

Teresa Stanek Rea

Teresa Stanek Rea
*Acting Director of the United States Patent and Trademark Office*